US007462791B1

(12) United States Patent
Flegel

(10) Patent No.: US 7,462,791 B1
(45) Date of Patent: Dec. 9, 2008

(54) INTERLOCK ASSEMBLY FOR SEQUENTIALLY ACTUATING POWER SUPPLY SWITCHES INCLUDING A NEUTRALLY CONNECTED SWITCH

(75) Inventor: David D. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 168 days.

(21) Appl. No.: 11/370,789

(22) Filed: Apr. 14, 2006

(51) Int. Cl.
*H01H 9/20* (2006.01)

(52) U.S. Cl. ..... 200/50.32; 200/50.33

(58) Field of Classification Search ..... 200/43.16, 200/5 EA, 50.1, 50.01, 50.32, 50.33, 50.37; 335/159–161
See application file for complete search history.

(56) References Cited

U.S. PATENT DOCUMENTS

| | | | | |
|---|---|---|---|---|
| 5,204,803 | A | 4/1993 | Runge | |
| 5,648,646 | A * | 7/1997 | Flegel | 200/50.32 |
| 5,805,414 | A | 9/1998 | Feldhaeusser | |
| 5,835,341 | A | 11/1998 | Rhodes et al. | |
| 6,031,193 | A | 2/2000 | Flegel | |
| 6,096,986 | A * | 8/2000 | Flegel | 200/50.33 |
| 6,184,595 | B1 | 2/2001 | Flegel | |
| 6,521,849 | B1 | 2/2003 | Flegel | |
| 6,927,349 | B1 * | 8/2005 | Flegel et al. | 200/50.32 |
| 7,145,089 | B2 * | 12/2006 | Bogdon et al. | 200/43.16 |
| 7,238,898 | B1 * | 7/2007 | Czarnecki | 200/50.32 |

OTHER PUBLICATIONS

"Main Lugs Generator Panel", Schneider Electric, www.Schneider-electric.ca/www/en/products/stab-lok/html/lugsgenerator.htm, Mar. 26, 2004, 3 pages.

* cited by examiner

*Primary Examiner*—Michael A Friedhofer
*Assistant Examiner*—Lisa N Klaus
(74) *Attorney, Agent, or Firm*—Boyle Fredrickson, S.C

(57) ABSTRACT

An interlock assembly for use with a pair of aligned multiple switch assemblies configured to control the supply of electrical power to an electrical panel. Each multiple switch assembly includes a two-pole transfer switch for a pair of "hot" conductors, and a single-pole transfer switch for a neutral connection. The interlock assembly is movably mounted relative to both of the multiple switch assemblies, and is configured to control a sequence of connection and interruption of each neutral connection relative to switching the hot conductors associated with switching each multiple switch assembly. The interlock assembly prevents the "hot" conductors of each multiple switch assembly from being connected without the associated respective neutral connection having been made in advance. The interlock assembly also ensures that the neutral connection of each multiple switch assembly is interrupted without previous interruption of the connection of the respective "hot" conductors.

27 Claims, 20 Drawing Sheets

FIG. 3
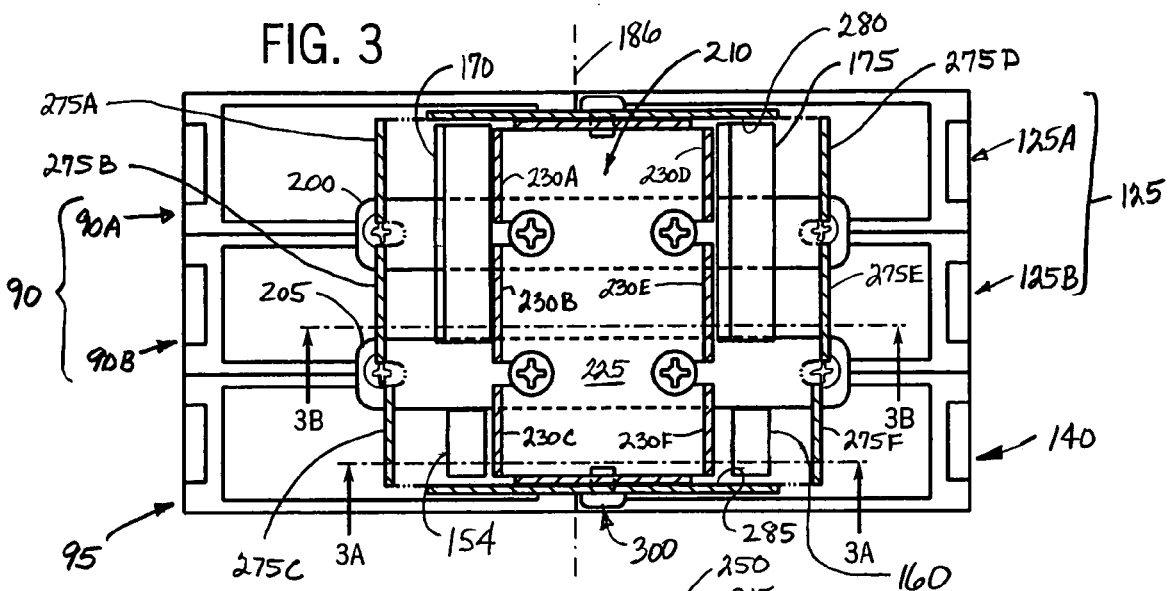
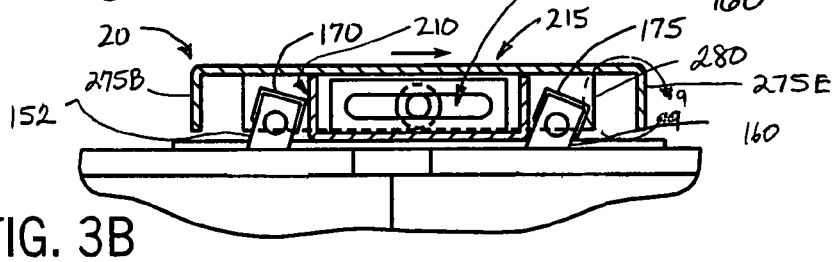
FIG. 3B
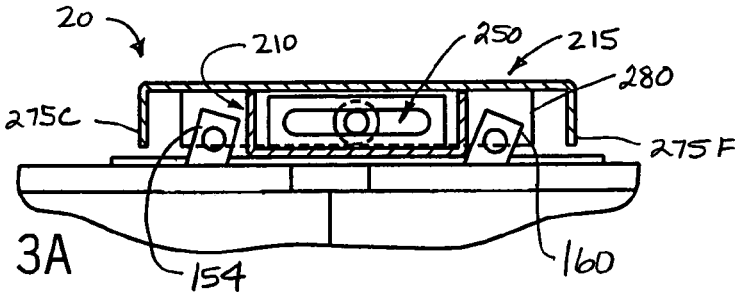
FIG. 3A
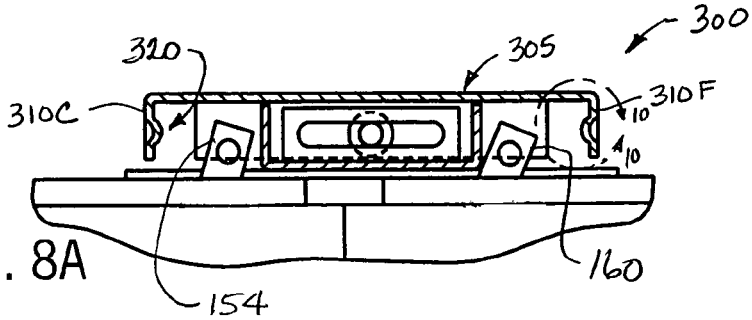
FIG. 8A

FIG. 5
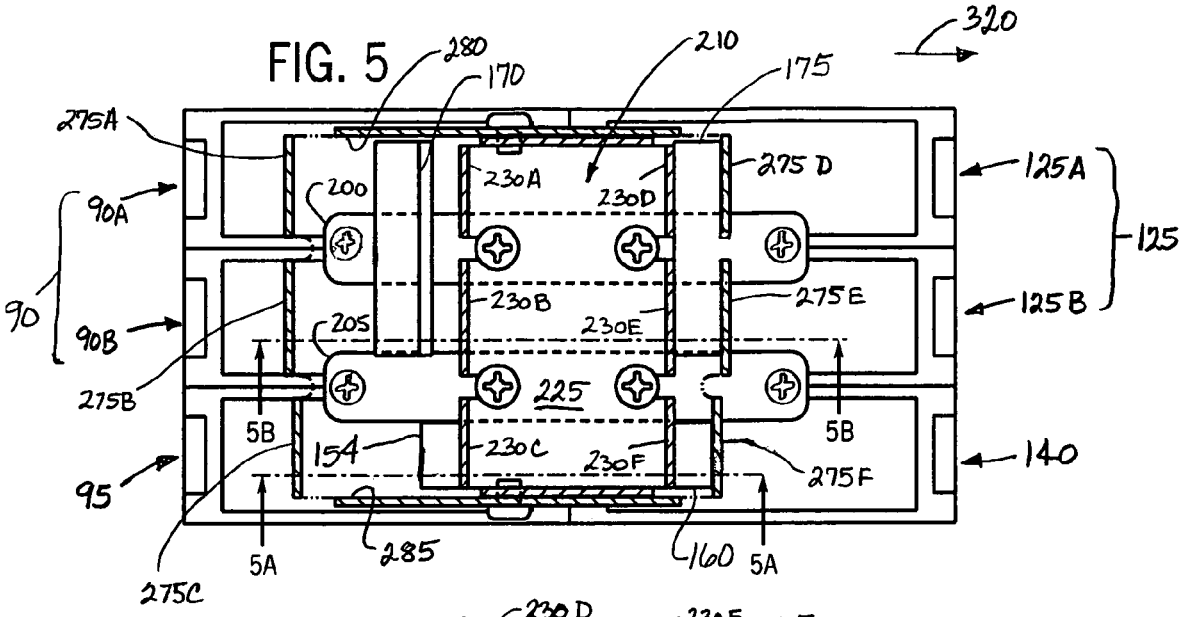
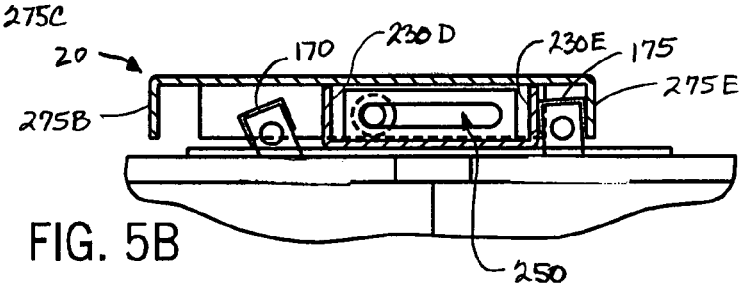
FIG. 5B
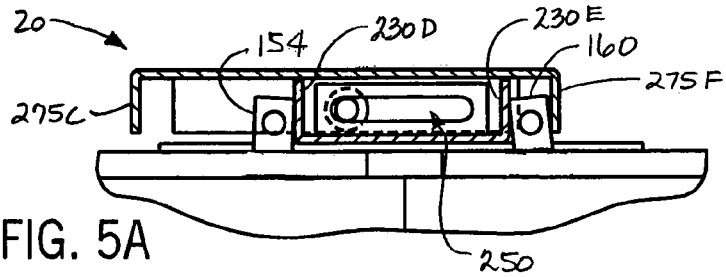
FIG. 5A
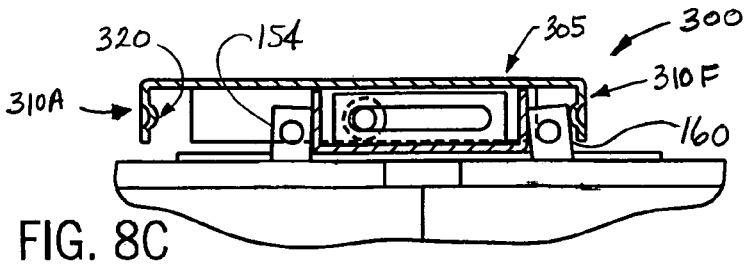
FIG. 8C

FIG. 8
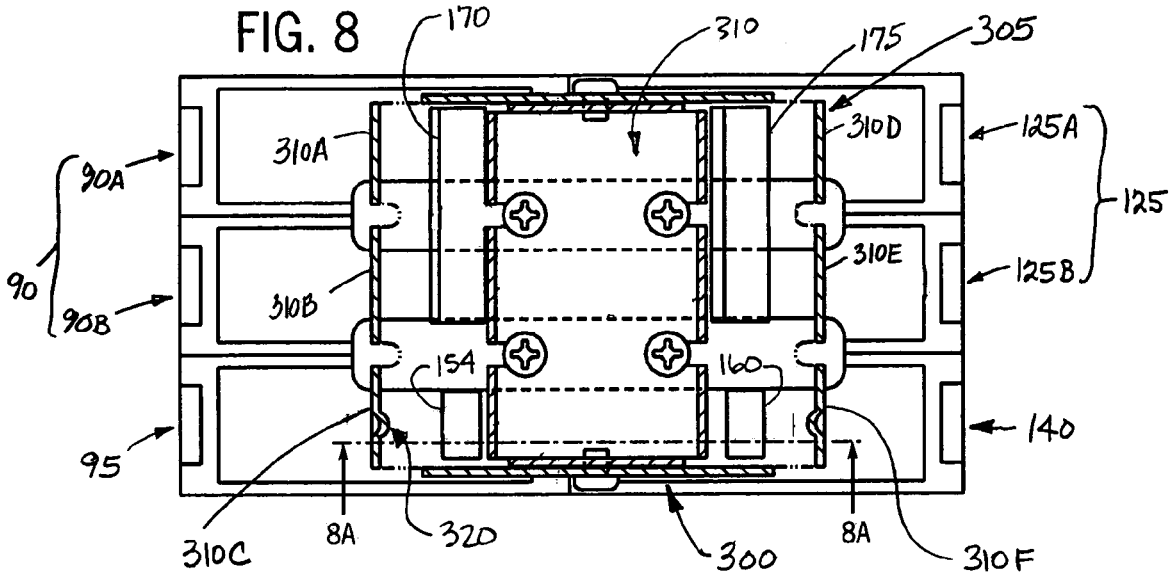
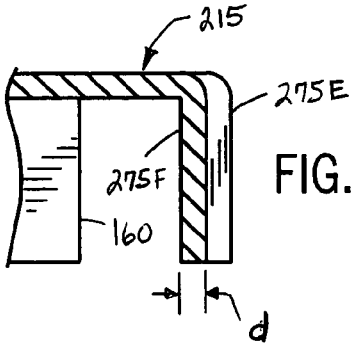
FIG. 9
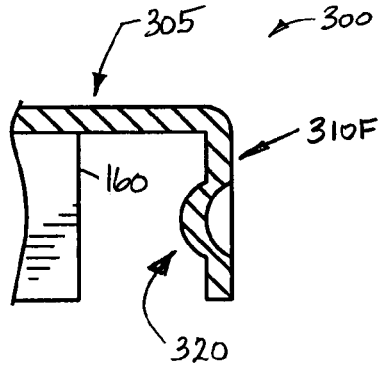
FIG. 10
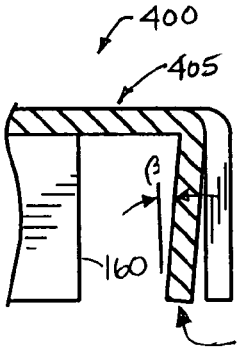
FIG. 11

FIG. 15
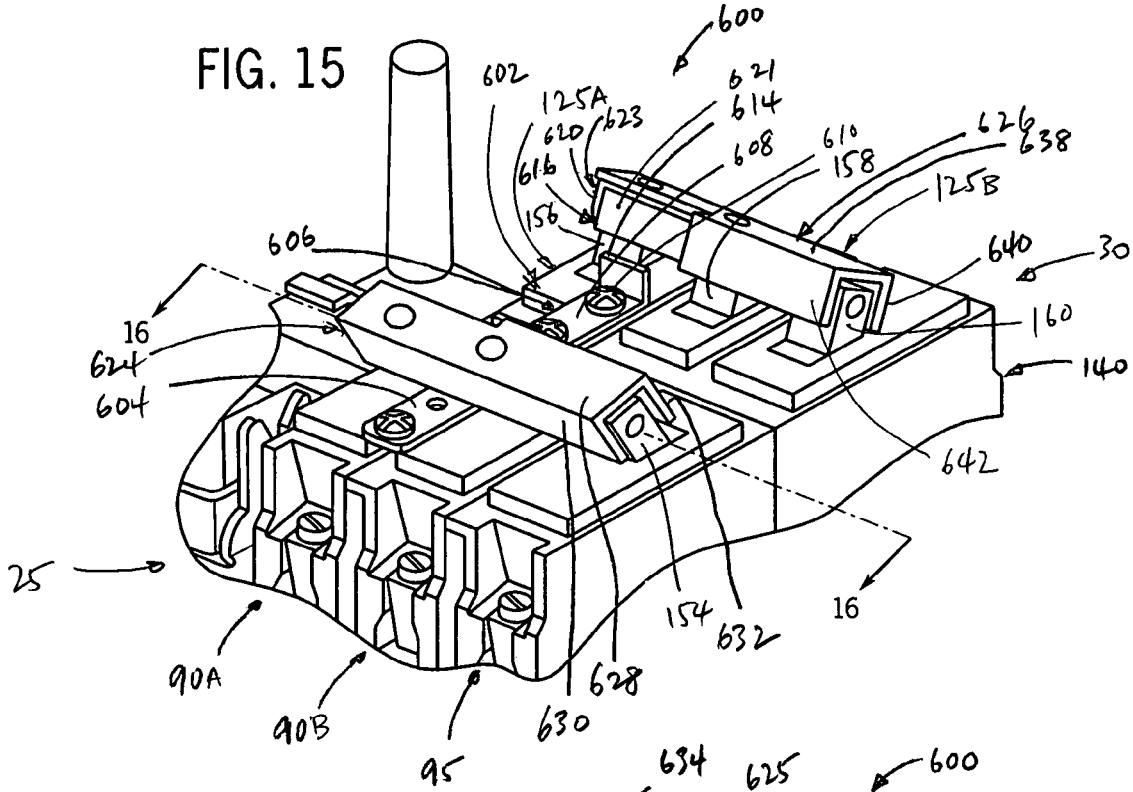
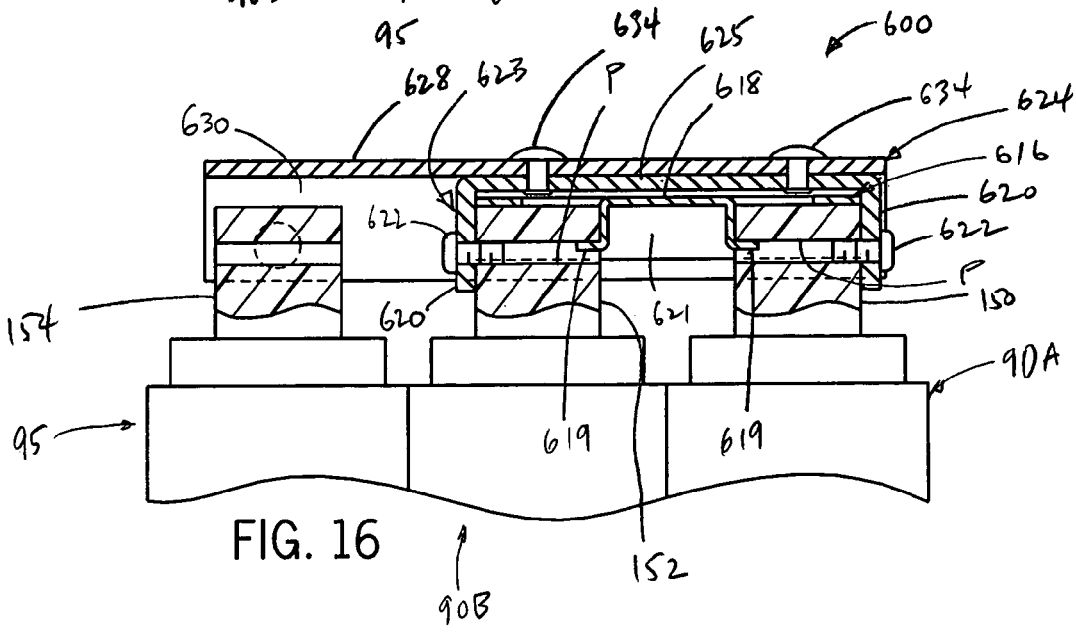
FIG. 16

FIG. 17
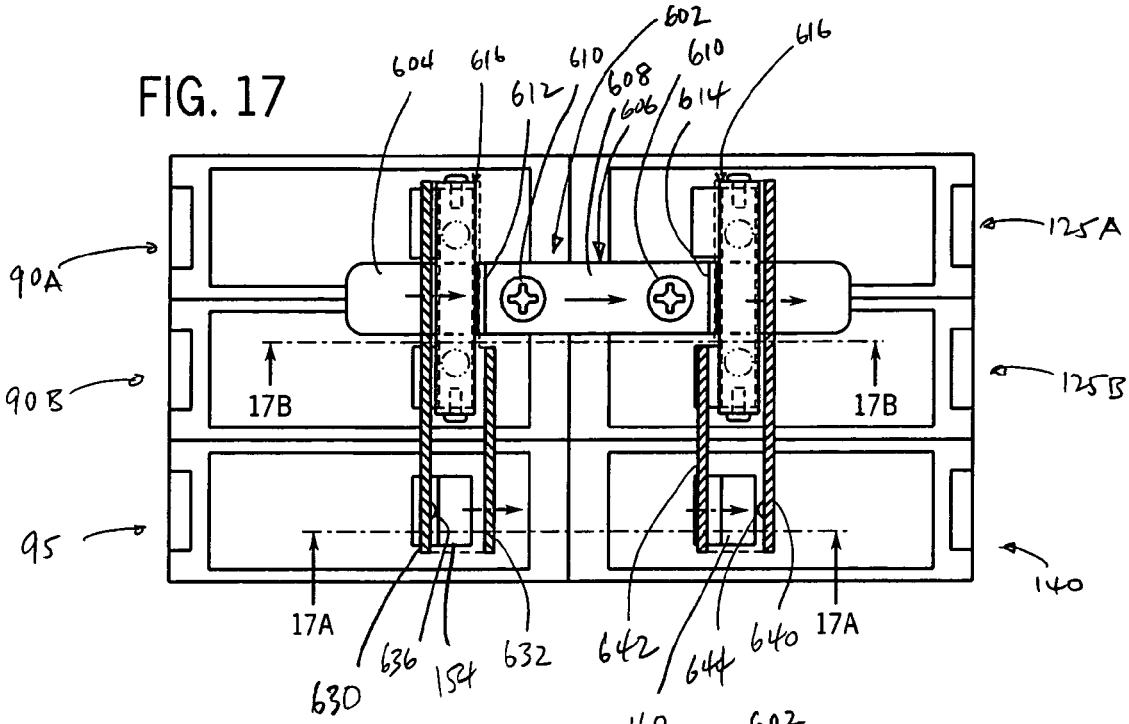
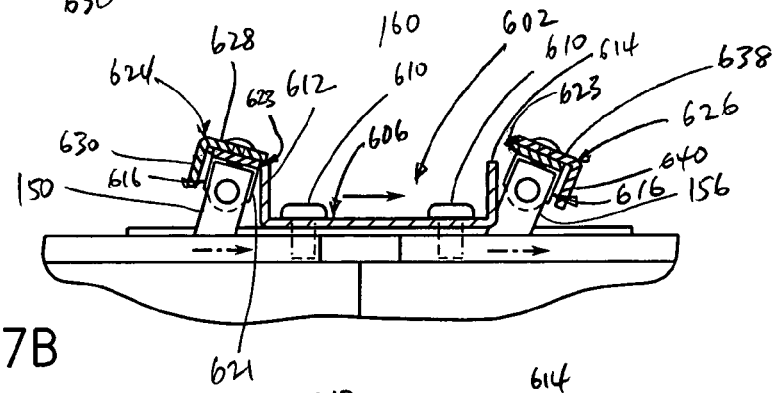
FIG. 17B
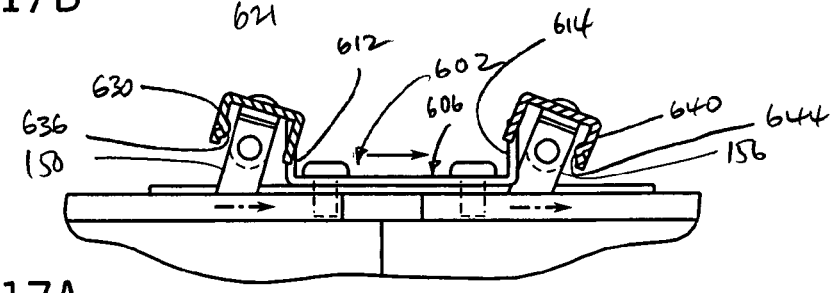
FIG. 17A

FIG. 18
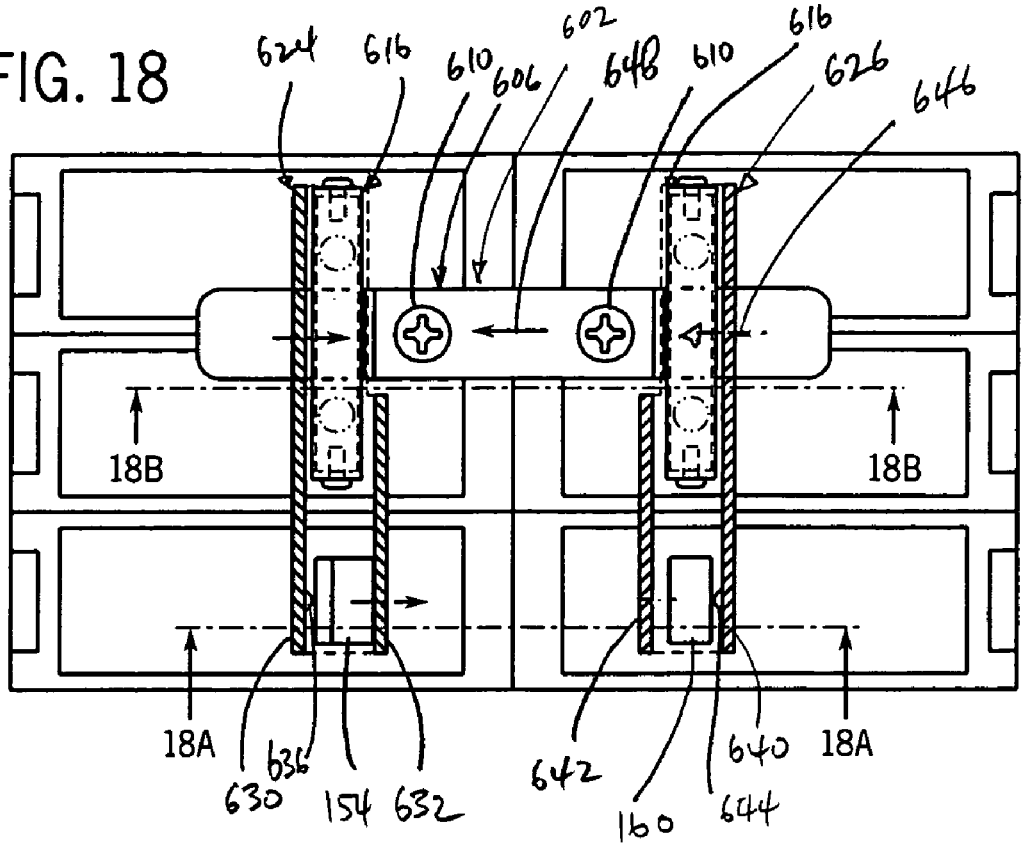
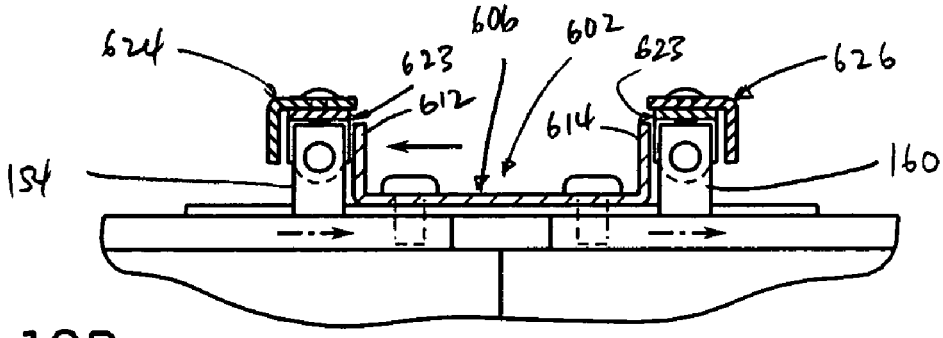
FIG. 18B
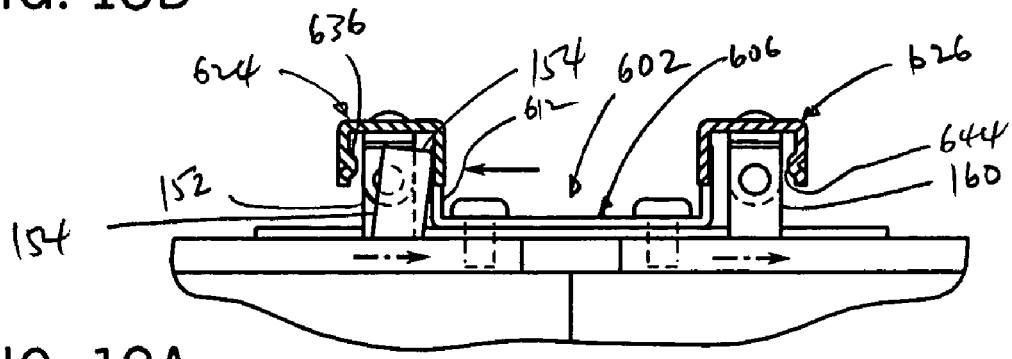
FIG. 18A

FIG. 19
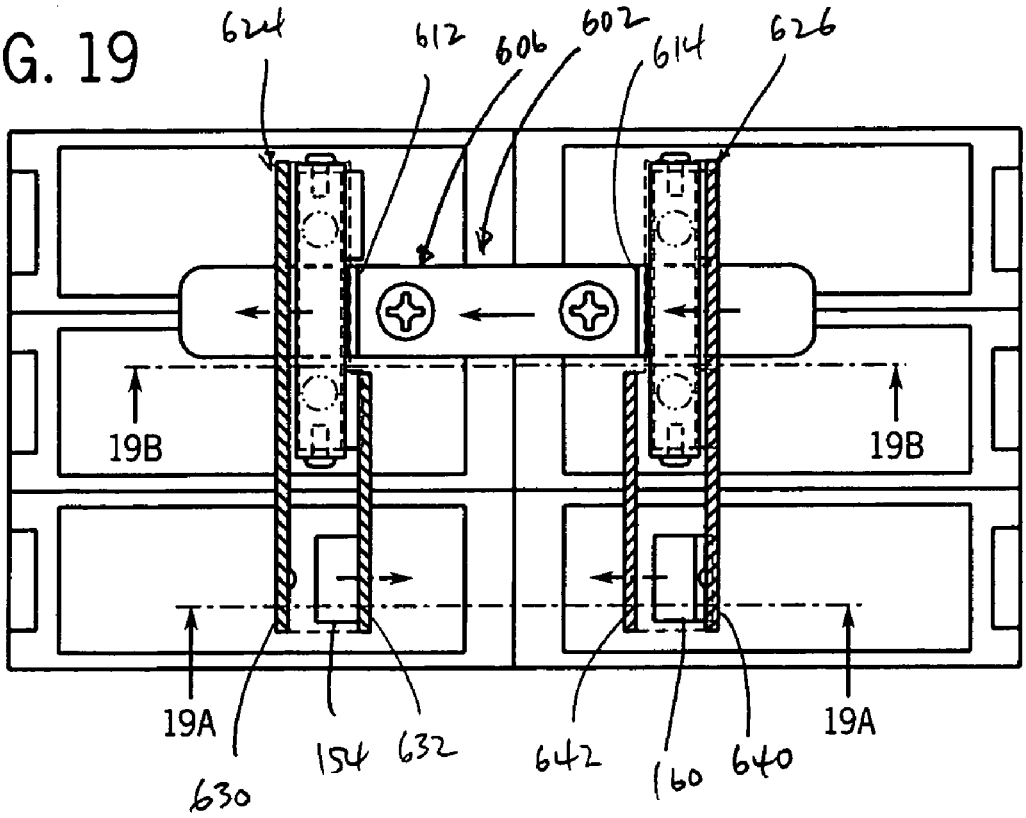
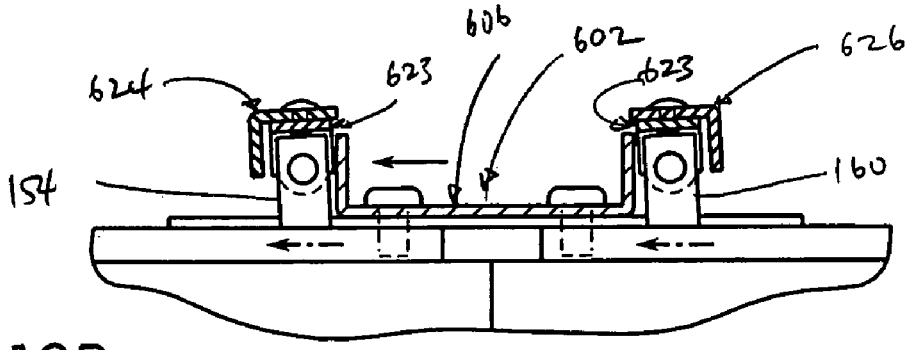
FIG. 19B
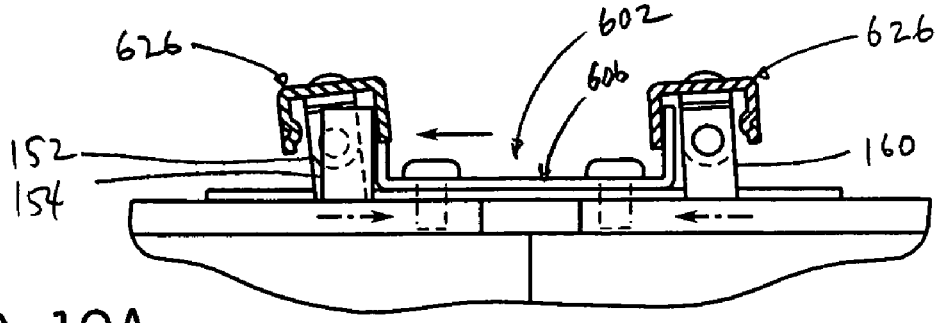
FIG. 19A

FIG. 20
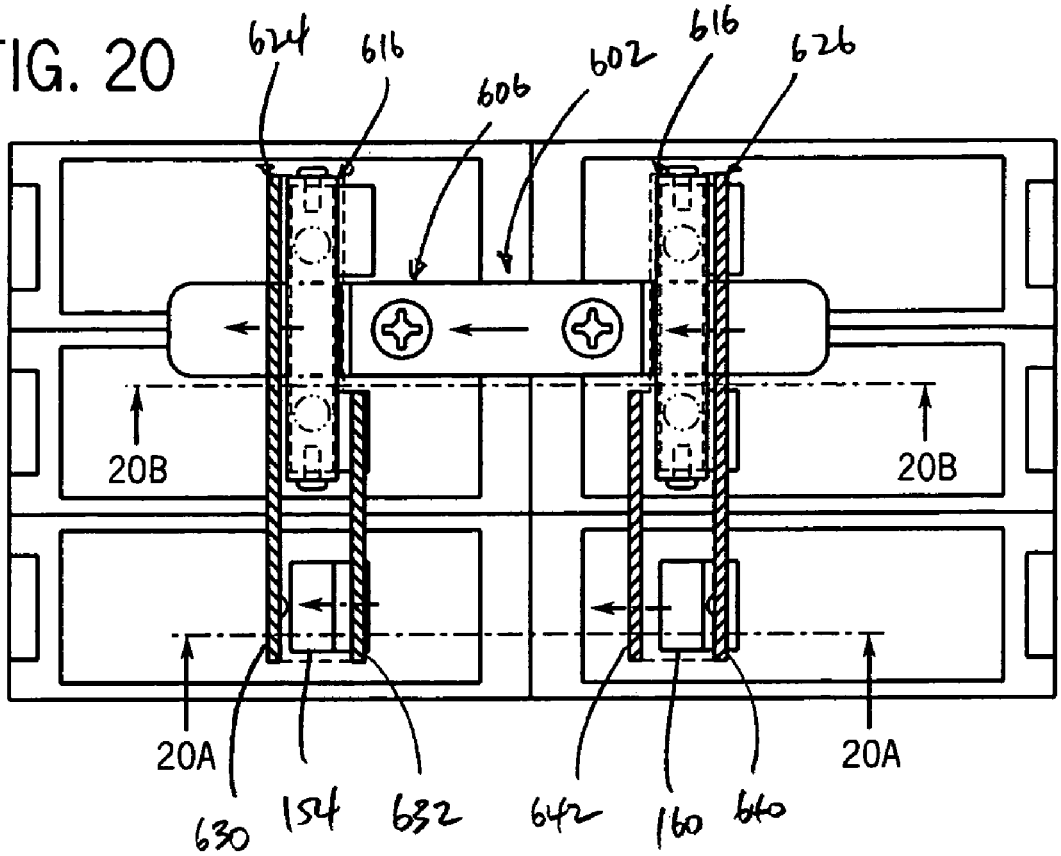
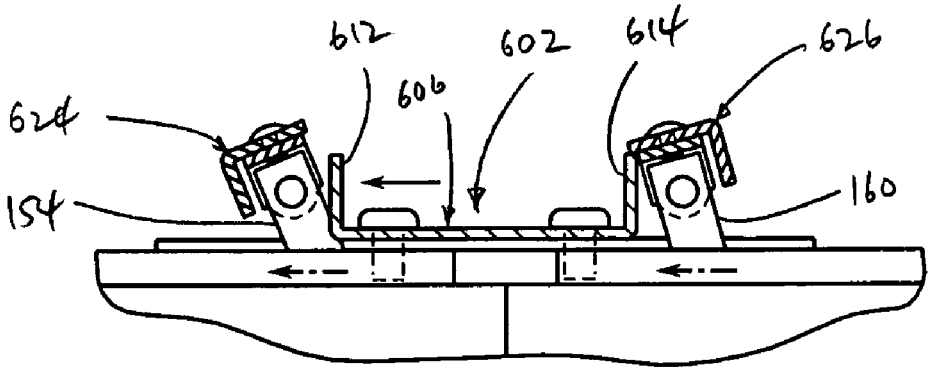
FIG. 20B
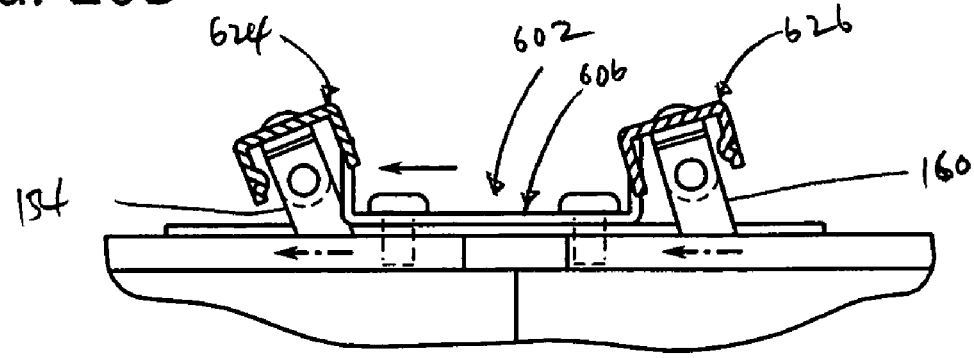
FIG. 20A

FIG. 23
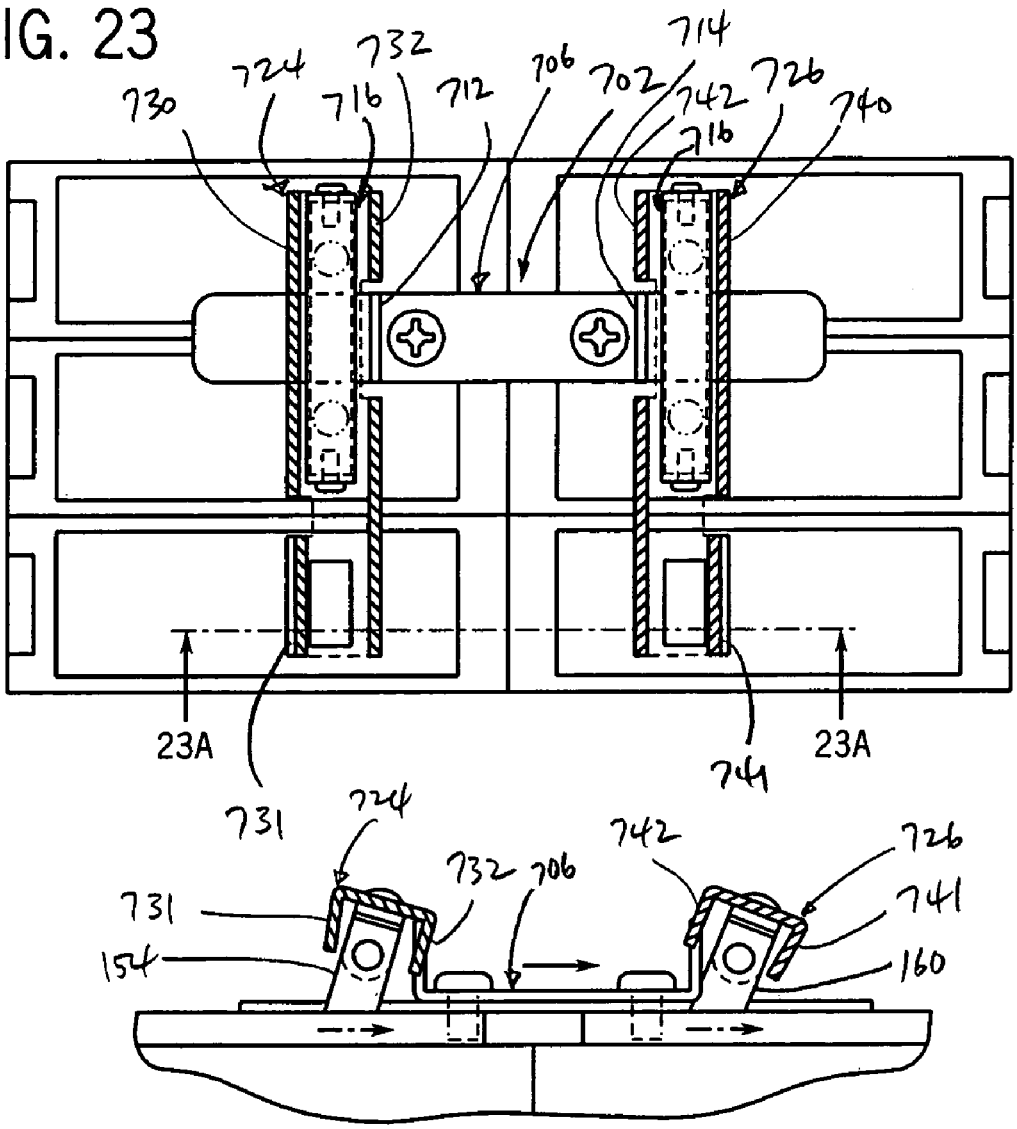
FIG. 23A
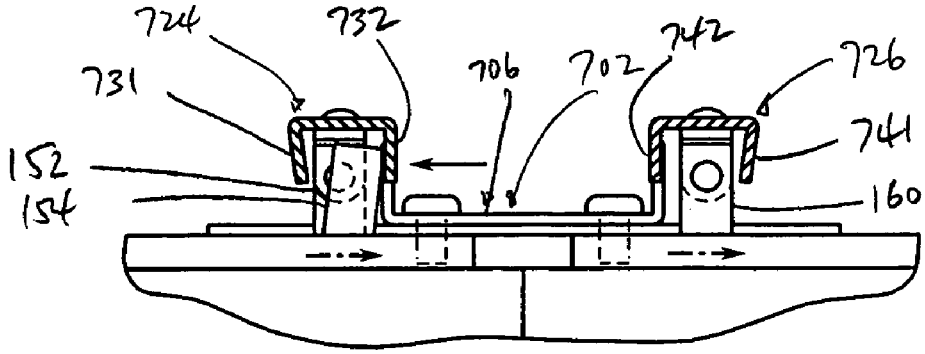
FIG. 23B

INTERLOCK ASSEMBLY FOR SEQUENTIALLY ACTUATING POWER SUPPLY SWITCHES INCLUDING A NEUTRALLY CONNECTED SWITCH

FIELD OF THE INVENTION

This invention relates to an interlock assembly for a load center, and more particularly to an interlock assembly that is configured to interrupt a neutral connection in a desired sequential manner during the process of transferring an electrical connection between a utility service and a generator.

BACKGROUND OF THE INVENTION

In today's electrical supply systems, there are occasions when alternate sources of electrical power are necessary or desirable. For example, the capability of switching from utility power to emergency generator power is extremely important for many businesses, hospitals and industries, as well as residential dwellings.

In certain applications, it is desirable for separate electrical circuits or even separate groups of electrical circuits to be arranged so that when one group of circuits is switched to a conductive state, another group of circuits is switched to a non-conductive state in an alternating fashion. In addition, it may be desirable to alternately switch a common load between separate power sources, so that as one power source is disconnected from the load, the second power source is connected after a negligible delay so as to limit interruption of electrical power to the common load. In order that the desired delay in alternate switching between power sources may be minimized, a need has been recognized to employ an interlock mechanism or assembly which functions to switch one group of circuits OFF as the other group of circuits is switched ON.

A certain known transfer-type electrical panel of a building, typically located adjacent to the service entrance electrical panel, includes a pair of transfer-type switches that selectively control the supply of electrical power from either a standard utility 125/250 VAC service or a generator power supply. This known type of transfer arrangement controls the supply of electrical power from the two "hot" conductors of the generator. The neutral conductor from the generator is directly connected to the neutral of the building electrical system, and the safety grounding conductor is bonded to a neutral bus at the service entrance panel. This system configuration is commonly referred to as a "non-separately derived system." The typical generator is a single-phase 125/250 VAC "floating-neutral" generator that includes an electrical outlet configured to provided two "hot" legs, a neutral, and a safety grounding conductor. A characteristic of the "floating-neutral generator is that the neutral conductor and the safety ground conductor are not bonded together.

There are instances in which it is desirable to use a 125/250 VAC "bonded-neutral" generator (which includes a neutral conductor and a safety ground conductor that are internally bonded together) for the purpose of powering structures or dwellings. A building is typically fed by a standard utility 125/250 VAC service that includes a neutral bus conductor connected to a safety ground bus conductor, and the safety ground bus conductor connected to a grounding rod or net. Using the non-separately derived configuration described above, the pair of "hot" conductors from the generator are connected to the appropriate poles of the two-pole transfer switch, the neutral conductor of the generator is permanently connected to the neutral bus conductor of the electrical panel, and the safety ground conductor of the generator is permanently connected to the safety ground bus conductor of the electrical panel.

However, this configuration has drawbacks when used with bonded-neutral generators. For example, assume the transfer switch of the above-described system configuration is in the ON position such that the generator is supplying electrical power via the pair of "hot" conductors to a common load in the building. Electrical current flows from one of the "hot" conductors of the generator through the transfer switch and through a conventional distribution breaker at the electrical panel of the dwelling in a known manner so as to power the electrical load in the building. The electrical current then returns via the neutral conductor of the load to the neutral bus conductor of the electrical panel. A first portion of electrical current then flows from the neutral bus conductor of the electrical panel back to the neutral conductor of the generator, thus completing the circuit path. A remaining portion of electrical current flows from the neutral bus conductor of the electrical panel to a neutral-to-ground tie bar at the electrical panel, through a ground bus conductor, back through the safety ground-to-neutral bonding conductor of the generator, and then through the neutral conductor of the generator, completing another circuit path. It is this undesired dual path for electrical current to follow back from the electrical load to the generator that creates a problem.

Rather than the dual path current flow described above, such a power system should be electrically grounded in such a manner that prevents a flow of electrical current via the neutral conductor of the building back to the safety ground conductor of the generator, in all situations except for an electrical power fault (q.v., Article 250 of the National Electrical Code). The safety ground conductor is expected to be pristine or absent of the normal flow of electrical current, and instead is to be used to conduct electrical current safely to ground only when there is an electrical fault occurrence. Thus, known system configurations are undesirable because such configurations allow a normal flow of electrically current to pass via the neutral conductor of the building to the safety ground conductor of the generator. Another drawback of above-described system configurations is that the flow of electrical current to the safety ground conductor of the generator is known to trigger a ground fault circuit interrupt at the generator. When triggered, the ground fault circuit interrupter will de-energize the "hot" conductors of the generator and prevent the supply of electrical power to the service bus conductor of the electrical panel.

In an attempt to address the drawbacks described above, a "separately-derived" system configuration can be employed. This system configuration uses a transfer switch arrangement that makes or breaks the neutral conductor as well as the two "hot" conductors of a "bonded neutral" generator. Again, for purposes of example, assume the transfer switches are initially positioned such that electrical current flows from one of the pair of "hot" electrical conductors of the generator to the common load of the building. Specifically, the electrical current flows from the "hot" conductors of the generator through the transfer switch in a known manner, and to the electrical load. The electrical current then returns via the neutral conductor of the electrical load. However, instead of electrical current flowing through the neutral bus conductor of the electrical panel, the flow of electrical current is routed by a separate neutral switch assembly to the neutral conductor of the generator, thus completing the circuit. Thereby, this system prevents the undesired flow of electrical current through the generator safety ground-to-neutral bonding conductor and back to the generator neutral conductor, as noted previously.

However, this known system configuration also has drawbacks, specifically involving the switching sequence of the neutral transfer switch assembly that controls the electrical connection of the neutral conductor of the utility service or generator with the neutral bus conductor of the building. In the switching sequence, there is a potential to execute an "open-neutral connection" switching event, which can occur when the transfer switch establishes connection of the "hot" conductors of the generator or utility service to the service bus conductor of the building before the transfer switch establishes connection of the neutral conductor of the generator or utility service to the neutral bus conductor of the building. An "open neutral" condition such as this may last for only a short period of time. Given that each of the operating handles (i.e., the handle interconnecting the switch for each "hot" conductor connection, and the handle for operating the neutral switch for the neutral connection) of the transfer switch are mechanically connected together, this system configuration can increase the delay or lag time between actual connection of the electrical contacts at each of the switched poles. In an open neutral switching event, the path for electrical current to return back via the neutral connection at the transfer switch assembly is interrupted for a short period of time. However, there is a complete circuit path for electrical current to flow from one "hot" conductor of the generator to the other. In this event, electrical loads that are normally connected in parallel can be connected in series. This series connection of electrical loads results in the same electrical current draw through each electrical load, causing much larger voltages to be experienced by the electrical loads. Under certain conditions, this can be the equivalent to plugging a standard 120-volt appliance into a 240-volt outlet, causing an undesirable over-voltage condition at the load. The lag time in closing the electrical contact of certain commonly used molded-case circuit breakers and switches can result in an "open neutral" connection switching event that can last as long as 10 milliseconds, increasing the statistical probability that an open-neutral switching event will occur at a voltage maximum that can result in the over-voltage condition at the load.

Another certain known system configuration uses an "overlapping-contact" transfer switch to individually control interruption of the neutral connection to the generator or the utility service at the electrical panel. This overlapping-contact transfer switch configuration establishes the neutral connection to the generator or utility service before breaking or interrupting the electrical connection to the neutral bus conductor of the building. However, the drawback of this system configuration is that the electrical connection of the neutral conductor of the generator with the neutral conductor of the utility service results in the flow of electrical current through the generator safety ground, which is undesired for reasons described above.

Therefore, there is a need for a transfer switching device that can be operated by a single mechanism to provide sequenced transfer switching between power supplies in an electrical panel, including neutral connection switching. There is also a desire for a interlock assembly configured to create the following switching sequence: interrupt connection of the presently connected "hot" conductors of a first power supply to the service bus conductor, then interrupt connection of the neutral conductor of the first power supply to the neutral bus conductor, then establish connection of the neutral conductor of the second power supply to the neutral bus conductor, and then finally to establish connection of the "hot" conductors of the second power supply to the service bus conductor, and vice versa. In this manner, at no time are the neutral conductors of the power supplies connected together. Furthermore, at no time are the "hot" conductors of either of the power supplies electrically connected to the service bus of the electrical panel without the associated neutral line conductor having been connected in advance to the neutral conductor of the electrical panel.

SUMMARY OF THE INVENTION

It is an object of the present invention to provide an interlock assembly that can be readily installed to provide a single operating mechanism to control switching between the supply of electrical power from a first (typically utility) power supply and/or a second (typically generator) power supply at a load center. In addition, it is an object of the present invention to provide an interlock assembly configured to make and/or break (e.g., regulate interruption) of each neutral line connection at the load center in a sequenced manner. It is another object of the present invention to provide an interlock assembly configured to provide control of switching between the supply of electrical power from utility service and from a generator in such a manner that connection of each respective neutral conductor is made before electrical connection of the respective "hot" conductors is made. In this manner, the interlock assembly prevents the "hot" conductors of the utility service or generator from being connected to the service bus conductor of the load center without the associated respective neutral line conductor having been first connected to the neutral bus conductor of the building in advance. Yet another object of the present invention is to provide an interlock assembly configured to interrupt connection of each neutral conductor of the generator or utility service after the connection of the associated "hot" conductors is interrupted, while assuring that the utility service and the generator do not simultaneously feed electrical power to each other or the service bus conductor of the load center. A still further object of the present invention is to provide an interlock assembly configured to ensure that connection of the neutral conductor of the utility service or generator cannot be interrupted without previous interruption of the connection of the respective "hot" conductors. Still another object of the present invention is to provide a means for linking or tying switch members of a number of switches together in a manner that results in simultaneous or sequential movement of the switch members between positions.

In accordance with one aspect, the present invention provides an interlock assembly for a first switch assembly aligned with a second switch assembly. The first switch assembly includes a first switch handle offset from a second switch handle, and the second switch assembly includes a third switch handle offset from a fourth switch handle. The first and second switch handles are disposed away from the third and fourth switch handles when all of the switch handles are in the OFF position, and towards one another when all of the switch handles are in the ON position. The second and fourth switch handles are aligned with one another and each is movable between an ON and an OFF position to break a neutral connection. The interlock assembly is movably and retainably mounted relative to the switch assemblies, and is configured to control a sequence of switching the second switch handle, and thereby interruption of a first neutral connection, relative to switching the first switch handle. The interlock assembly is also configured to control a sequence of switching the fourth switch handle, and thereby interruption of a second neutral connection, relative to the switching the third switch handle.

The preferred interlock assembly is configured to interrupt the first neutral connection after the first switch handle is in the OFF position, and to interrupt the second neutral connection after the third switch handle is in the OFF position. The interlock assembly includes a series of stops, including a first stop configured to move the second switch handle to the OFF position and break the first neutral connection after a second stop moves the first switch handle to the OFF position. The interlock assembly is also configured to move the second switch handle to the ON position and to make the first neutral connection before the interlock assembly moves the first switch handle to the ON position. The interlock assembly further includes a third stop configured to move the fourth switch handle to the OFF position, and thereby break the second neutral connection, after a fourth stop moves the third switch handle to the OFF position. The interlock assembly is further configured to move the fourth switch assembly to the ON position, and thereby make the second neutral connection, before the interlock assembly moves the third switch handle to the ON position.

In accordance with another aspect, the present invention provides an interlock assembly for a first switch assembly aligned with a second switch assembly. The first switch assembly includes a first switch handle offset from a second switch handle, and the second switch assembly includes a third switch handle offset from a fourth switch handle. The first and second switch handles are disposed away from the third and fourth switch handles when all of the external switch handles are in the OFF position, and towards one another when all of the switch handles are in the ON position. The second and fourth switch handles are aligned with one another, and each is movable between an ON and an OFF position to control making and breaking a neutral connection. The interlock assembly further includes a control mechanism movably and retainably mounted relative to the switch assemblies. The control mechanism includes a series of interior stops each being disposed between all of the switch handles for engagement therewith, and a series of exterior stops each being disposed on the opposite side of all of the switch handles relative to the series of interior stops. The control member and the series of interior and exterior stops are constructed and arranged such that moving the first and second switch handles from an OFF to an ON position functions to move the third and fourth switch members from the ON to the OFF position.

The invention also contemplates an electrical panel for switching between a first power source and a second power source. The panel includes a first multiple switch assembly having first and second manually operable switch handles. The first switch handle is movable in a first direction between an ON position and OFF position for controlling the supply of electrical power from the first power source to a service bus conductor of the electrical panel. The second switch handle is movable between an ON and an OFF position for controlling a first neutral connection of a neutral conductor of the first power source to a neutral bus conductor of the electrical panel. A second multiple switch assembly includes a third switch handle and fourth switch handle. The third switch handle is aligned with the first switch handle and is movable in the first direction between an ON and OFF position for controlling the supply of electrical power to the electrical panel from the second power source. The fourth switch handle is aligned with the second switch handle and is movable between an ON and an OFF position to break a second neutral connection between a neutral conductor of the second power source with the neutral bus conductor of the electrical panel. The panel further includes an interlock assembly movably and retainably mounted relative to the switch assemblies. The interlock assembly includes a series of spaced apart interior stops each being disposed between the switch members for engagement therewith. The interlock assembly further includes a series of exterior stops each being disposed on the opposite side of the switch handles relative to the series of spaced apart interior stops. The control member and the series of interior and exterior stops are constructed and arranged such that moving the first and second switch handles from an OFF to an ON position functions to move the third and fourth switch handles from the ON to the OFF position.

The invention also contemplates a method of interlocking a first and a second switch handle of an aligned first multiple switch assembly with a third and a fourth switch handle of an aligned second multiple switch assembly, substantially in accordance with the foregoing summary.

A still further aspect of the invention contemplates a method of connecting a first switch member of a first switch assembly to a second switch member of an adjacent second switch assembly. Each switch member includes a transverse passage. The method is carried out by extending a tie member through the passage of the first switch member into engagement within the passage of the second switch member. In one form, the second switch member of the adjacent second switch assembly is interconnected for movement with a third switch member of a third switch assembly located adjacent the second switch assembly. The act of extending a tie member through the passage of the first switch member is carried out by extending a threaded tie member through the passage of the first switch member and securing the threaded tie member to the first switch member using a threaded nut, so that a portion of the threaded tie member extends beyond the nut into engagement with the passage of the second switch member. This aspect of the invention also contemplates a switch arrangement including a pair of switch assemblies, each of which includes a switch member. The switch members are linked together for movement. A third switch assembly is located adjacent the pair of switch assemblies, and also includes a switch member. A connection member extends between the switch member of the third switch assembly and one of the switch members of the pair of switch assemblies, and the switch member of the third switch assembly is movable along with the switch members of the pair of switch assemblies.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a top plan view, partially in cross-section, of the interlock assembly in combination with the transfer switch assemblies of the electrical panel of FIG. 1, showing the interlock assembly in a first operative position;

FIG. 3A is a section view along line 3A-3A of FIG. 3;

FIG. 3B is a section view along line 3B-3B of FIG. 3;

FIG. 5 is a top plan view, partially in cross-section, of the interlock assembly in combination with the transfer switch assemblies of the electrical panel of FIG. 1, showing the interlock assembly in a third operative position;

FIG. 5A is a section view along line 5A-5A of FIG. 5;

FIG. 5B is a section view along line 5B-5B of FIG. 5;

FIG. 8 is a top plan view, partially in cross-section, of another embodiment of an interlock assembly in accordance with the present invention in combination with transfer switch assemblies of the electrical panel of FIG. 1, showing the interlock assembly in a first operative position;

FIG. 8A is a section view along line 8A-8A of FIG. 8, showing the interlock assembly in a first operative position similar to FIG. 3A;

FIG. 8C is a section view similar to FIG. 8A, showing the interlock assembly in a third operative position similar to FIG. 5A;

FIG. 9 is a detailed section view with reference to line 9-9 of FIG. 3B, showing one embodiment of a stop incorporated in the interlock assembly in accordance with the present invention;

FIG. 10 is a detailed section view with reference to line 10-10 of FIG. 8A, showing another embodiment of a stop incorporated in the interlock assembly in accordance with the present invention;

FIG. 11 is a detailed section view similar to FIGS. 9 and 10, showing yet another embodiment of a stop incorporated in the interlock assembly in accordance with the present invention;

FIG. 15 is a partial isometric view showing another embodiment of an interlock assembly in accordance with the present invention, for providing sequential actuation of switches including a neutral switch;

FIG. 16 is a partial section view taken along line 16-16 of FIG. 15;

FIG. 17 is a top plan view, partially in cross-section, of the interlock assembly of FIG. 15 in combination with the transfer switch assemblies of the electrical panel of FIG. 1, showing the interlock assembly in a first operative position;

FIGS. 17A and 17B are section views taken along lines 17A-17A and 17B-17B, respectively, of FIG. 17;

FIG. 18 is a view similar to FIG. 17 showing the interlock assembly of FIGS. 15-17 in a second operative position;

FIGS. 18A and 18B are section views taken along lines 18A-18A and 18B-18B, respectively, of FIG. 18;

FIG. 19 is a view similar to FIGS. 17 and 18 showing the interlock assembly of FIGS. 15-17 in a third operative position;

FIGS. 19A and 19B are section views taken along lines 19A-19A and 19B-19B, respectively, of FIG. 19;

FIG. 20 is a view similar to FIGS. 17-19 showing the interlock assembly of FIGS. 15-17 in a fourth operative position;

FIGS. 20A and 20B are section views taken along lines 20A-20A and 20B-20B, respectively, of FIG. 20;

FIG. 23 is a top plan view, partially in cross-section, of the interlock assembly of FIG. 22 in combination with the transfer switch assemblies of the electrical panel of FIG. 1, showing the interlock assembly in a first operative position;

FIG. 23A is a partial section view taken along line 23A-23A of FIG. 23, showing the interlock assembly of FIGS. 21-23 in a first operative position;

FIGS. 23B-23D are partial section views similar to FIG. 23A, showing the interlock assembly of FIGS. 21-23 in sequential operative positions;

DETAILED DESCRIPTION OF THE INVENTION

Figure 1:
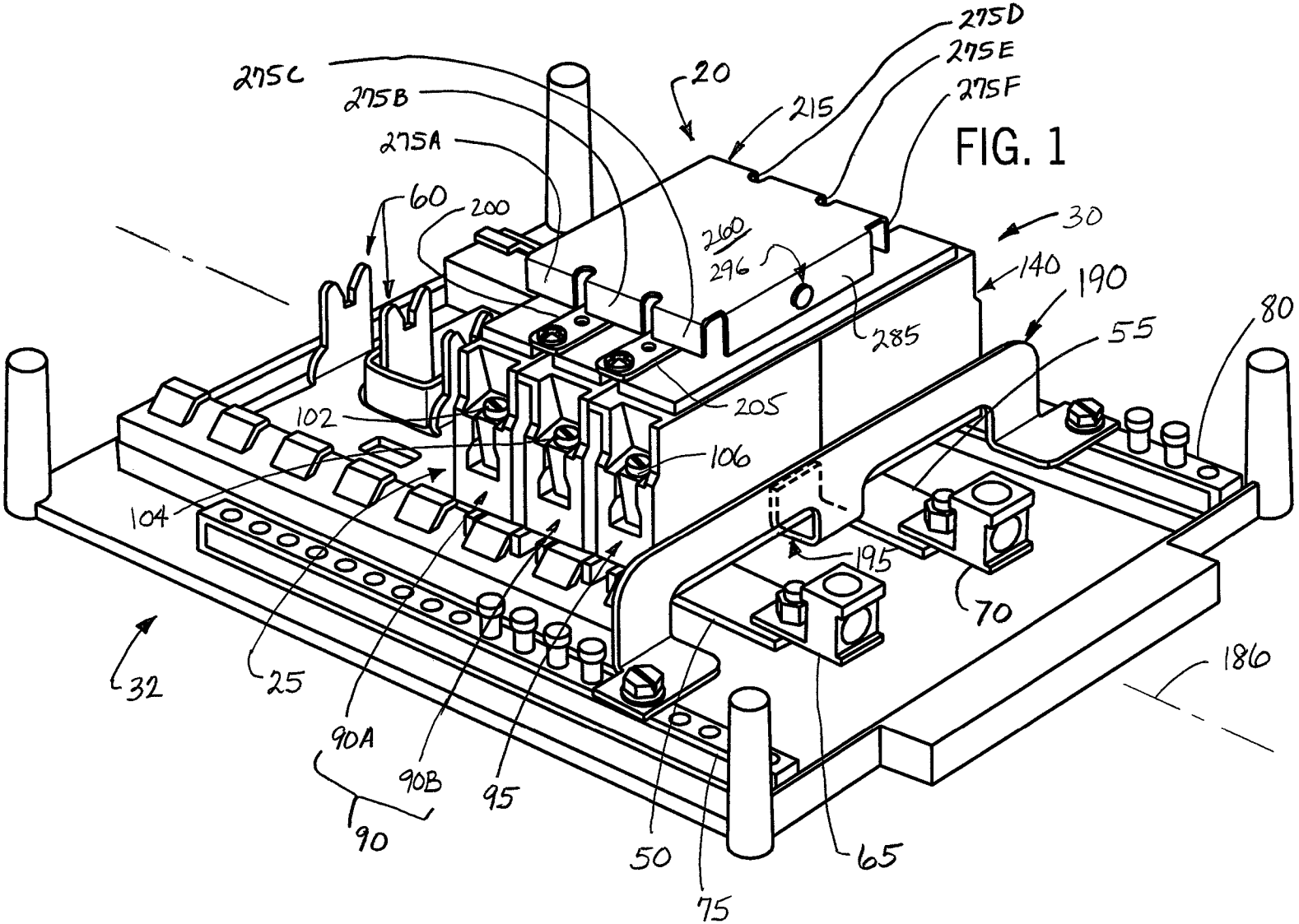
FIG. 1 is an isometric view of an assembled electrical panel with an interlock assembly constructed in accordance with the present invention.
Figure 1A:
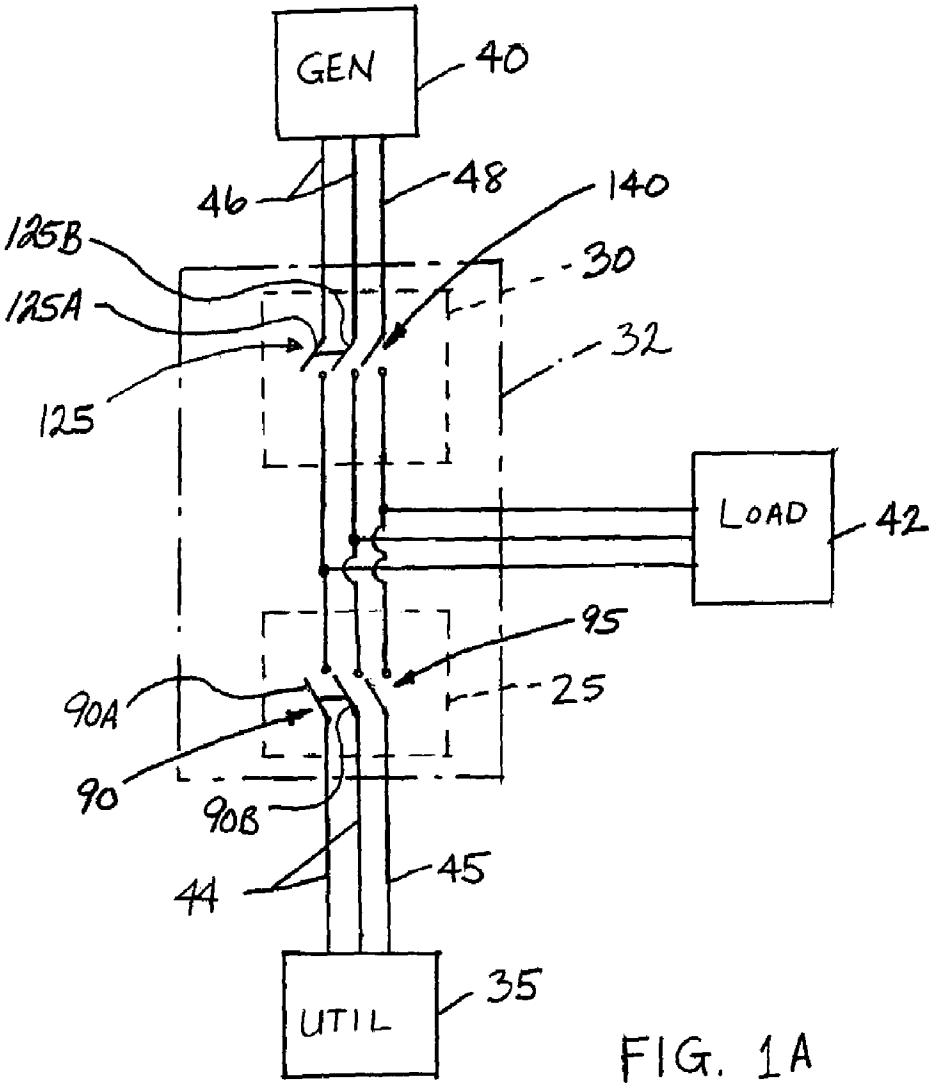
FIG. 1A is a circuit diagram illustration of a first multiple switch assembly and a second multiple switch assembly electrically connected for switching between supply of electrical power from a utility service and generator to an electrical load via the electrical panel of FIG. 1.

FIG. 1 illustrates one embodiment of an interlock assembly 20 for a pair of opposed multiple switch assemblies 25 and 30 in accordance with the present invention. The pair of opposed multiple switch assemblies 25 and 30 are electrically connected at a load center or electrical panel 32 of a building (e.g., hospital, residential unit, factory, etc.). FIG. 1A is a circuit diagram that illustrates the electrical connection to the electrical panel 32 in a manner generally configured to switch the supply of electrical power between a utility service 35 and a generator 40 to an electrical load 42. The utility service 35 generally includes a pair of "hot" line conductors 44 and a neutral conductor 45 electrically connected to the electrical panel 32. In a similar manner, the generator source 40 includes a pair of "hot" line conductors 46 and a neutral conductor 48 electrically connected to the electrical panel 32.

1. Electrical Panel

Referring back to FIG. 1, the preferred electrical panel 32 may representatively be a single-phase panel board as manufactured by SIEMENS™, catalog number G1624L1125CU. The electrical panel 32 generally includes a first service bus conductor 50 and a second service bus conductor 55 each having a series of stabs 60. Each stab 60 is configured to receive and electrically connect a circuit breaker or transfer switch assembly (described later) in a conventional manner so as to control making and interrupting electrical connection to the first and second service bus conductors 50 and 55, respectively. The first service bus conductor 50 is connected to a first bus lug 65, and the second service bus conductor 55 is connected to a second bus lug 70. Each bus lug 65 and 70 is adapted to be electrically connected to another control panel or load (not shown). The electrical panel 32 further includes a pair of parallel, neutral side bars 75 and 80, each of which constitutes an electrically conductive common junction for the electrical connection with return neutral wires or conductors (not shown) from distribution branch circuits connected to the electrical panel 32.

Referring now to FIGS. 1 and 1A, the first multiple switch assembly 25 is configured to control the feed of electrical power from the utility service 35 to the electrical panel 32. The first multiple switch assembly 25 generally includes a two-pole circuit transfer switch 90, which consists of a pair of single-pole transfer switches 90A and 90B, operable to selectively make or interrupt the flow of electrical power via "hot" conductors 44 (FIG. 1A) to the first and second service bus conductors 50 and 55 of the electrical panel 32 (FIG. 1). The multiple switch assembly 25 also includes a single-pole transfer switch 95 which is operable to selectively make or interrupt electrical connection of a neutral conductor 45 of the utility service 35 (FIG. 1A) to the neutral side bars 75 and 80 of the electrical panel 32 (FIG. 1). Referring specifically to FIG. 1, the two-pole transfer switch 90 of the first multiple switch assembly 25 is positioned adjacent the single-pole transfer switch 95. The two-pole transfer switch 90 is snapped onto stabs 60 in a conventional manner for electrical connection to the first and second service bus conductors 50 and 55. The two-pole transfer switch 90 generally includes electrical terminals 102 and 104 configured in a conventional manner to be electrically connected to the pair of "hot" conductors 44 from the utility service 35 (FIG. 1A). The single-pole switch 95 includes an electrical terminal 106 configured in a conventional manner to be electrically connected to the neutral conductor 45 of the utility service 35 (FIG. 1A).

Still referring to FIGS. 1 and 1A, the second multiple switch assembly 30 is configured to control the supply of electrical power from the generator source 40 to the electrical panel 32 (FIG. 1A). The second multiple switch assembly 30 includes a two-pole transfer switch 125, which consists of a pair of single-pole switches 125A and 125B, operable to selectively make or interrupt the flow of electrical power via "hot" conductors 46 of the generator 40 (FIG. 1A) to the first and second service bus conductors 50 and 55 of the electrical panel 30 (FIG. 1). The multiple switch assembly 30 further includes a single-pole transfer switch 140 operable to selectively make or interrupt electrical connection of a neutral conductor 48 of the generator 40 (FIG. 1A) to the neutral side bars 75 and 80 of the electrical panel 32 (FIG. 1). In a similar construction to the first two-pole switch 90, the second two-pole switch 125 includes conventional electrical terminals (not shown) configured to be electrically connected in a conventional manner to the pair of "hot" conductors 46 of the generator source 40 (FIG. 1A), and a single-pole transfer switch 140 with a conventional electrical terminal (not shown) adapted to be electrically connected in a conventional manner to the neutral line conductor 48 of the generator 40 (FIG. 1A). Also in a similar manner to the two-pole transfer switch 90, the two-pole transfer switch 125 is mounted or plugged in a conventional manner to the stabs 60 of the electrical panel 32, in electrical connection to the service bus conductors 50 and 55 (FIG. 1).

Figure 2:
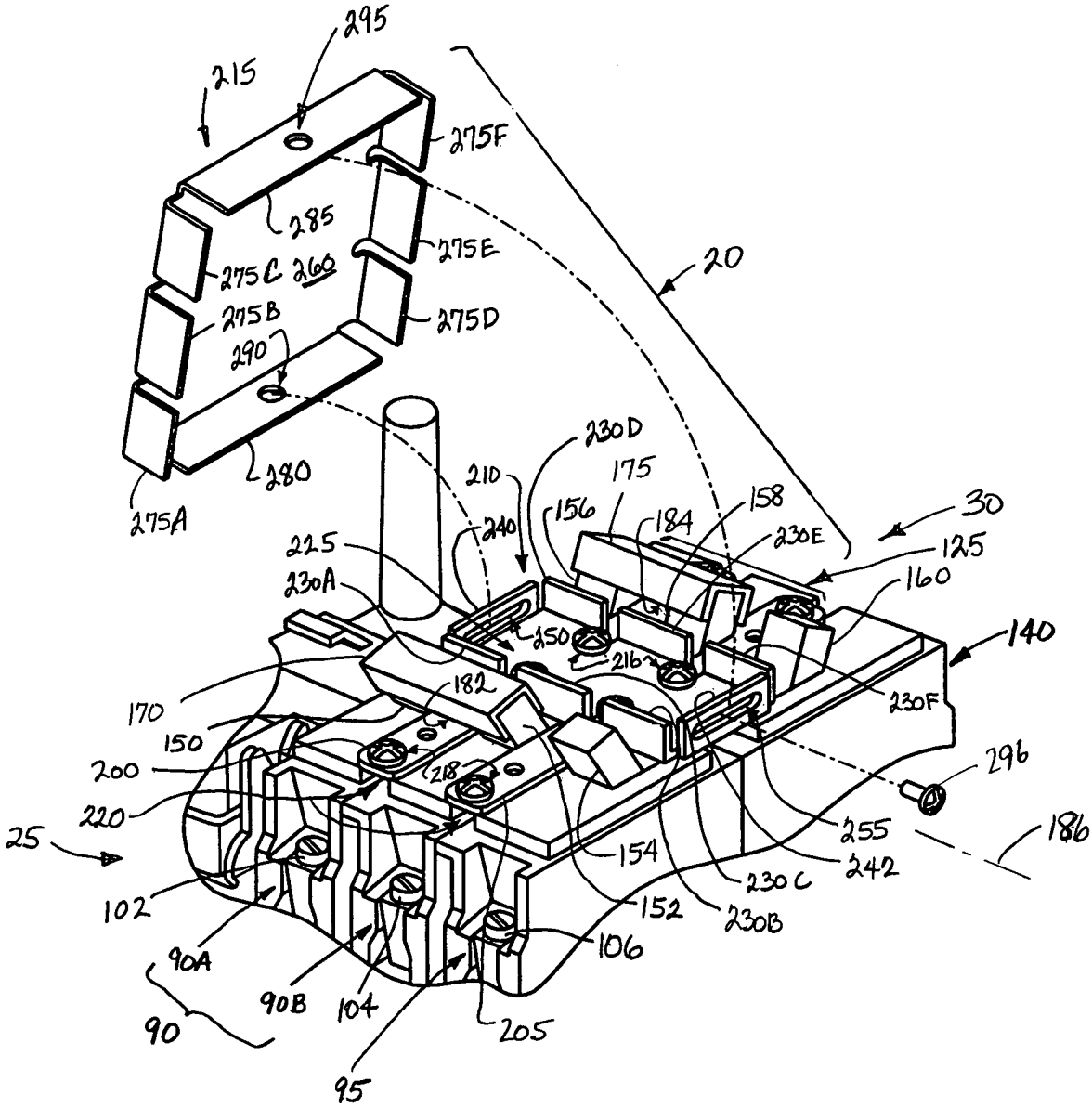
FIG. 2 is an enlarged isometric view of the interlock assembly in combination with the transfer switch assemblies of the electrical panel of FIG. 1, showing an upper interlock member of the interlock assembly removed.

Referring now to FIG. 2, in a similar manner to the first multiple switch assembly 25, the two-pole transfer switch 125 of the second multiple switch assembly 30 is positioned adjacent the single-pole transfer switch 140. The preferred transfer switches 90, 95, 125 and 140 depicted in FIG. 1 are standard, commercially available electrical switch mechanisms of the type manufactured by the ITE Circuit Protection Division of Siemens Energy and Automations Inc™. Each of the preferred two-pole transfer switches 90 and 125 is a Type QP, two-pole switch.

Still referring to FIG. 2, the transfer switches 90A, 90B, 95, 125A, 125B and 140 includes spring-biased, over-the-center switch handles 150, 152, 154, 156, 158 and 160, respectively. In normal operation, switch handles 150, 152, 154, 156, 158 and 160 can be manually operated between ON and OFF positions, and are designed such that when in an ON position and a current overload occurs, an internal mechanism (not shown) causes the respective device to switch to the OFF position in a conventional manner. It is understood, however, that the specific type of transfer switches 90, 95, 125, and 140 and respective handles 150, 152, 154, 156, 158 and 160 can vary from that which is shown and described.

The switch handles 150 and 152 of the two-pole transfer switch 90 and the switch handles 156 and 158 of the two-pole switch 125 are positioned laterally adjacent to each other, and are interconnected and ganged together. The switch handles 150 and 152 of two-pole transfer switch 90 are ganged together by a first handle tie bar or cap 170. In a like manner, the switch handles 156 and 158 of the two-pole transfer switch 125 are ganged together by a second handle tie bar or cap 175. Alternatively, the switch handles 150 and 152 of the two-pole transfer switch 90 and/or the switch handles 156 and 158 of the two-pole switch 125 may also be interconnected via internal connections in a conventional manner as is known. Handle ties 170 and 175 define recesses 182 and 184, respectively, between the pair of switch handles 150, 152 and the pair of switch handles 156, 158, respectively. Each handle tie 170 and 175 generally includes an inwardly facing surface and an outwardly facing surface relative to a central axis (illustrated as a dashed line and reference 186) of the electrical panel 32. In another alternative embodiment (not shown), the pair of switch handles 150, 152 and the pair of switch handles 156, 158 can be unitarily formed and ganged together.

Still referring to FIG. 2, the first and second switch assemblies 25 and 30 are tandem aligned in an opposed relationship to each other. The tandem aligned switch assemblies 25 and 30 are oriented such that the switch handles 150, 152 and 154 of the first switch assembly 25 and the switch handles 156, 158 and 160 of the second switch assembly 30 are positioned away from one another, respectively, when all are in the OFF position. In a similar manner, the switch handles 150, 152 and 154 of the first switch assembly 25 and the switch handles 156, 158 and 160 of the second switch assembly 30 are positioned toward one another when all are in the ON position.

Although the illustrated embodiment of the electrical panel 32 in FIGS. 1 and 1A only shows a multiple switch assembly 25 to control the feed of electrical power from the utility service 35 and a multiple switch assembly 30 to control the feed of electrical power from a generator 40, other circuit breaker switches (not shown) are typically mounted on the electrical panel 32 to control the supply of power to the various branch circuits of the building, when electrical power is supplied to the panel 32 from either the utility service 35 or from the generator 40.

Referring back to FIG. 1, the electrical panel 32 further includes a neutral bracket member 190, which provides a neutral connection area in the center of electrical panel 32. Details of the neutral bracket member 190 are shown and described in copending patent application Ser. No. 11/264,564 filed Nov. 1, 2005, the disclosure of which is hereby incorporated by reference in its entirety. In the illustrated embodiment, the neutral bracket member 190 is a unitary fabricated or molded member formed of an electrically conductive material. The neutral bracket member 190 is electrically interconnected between the neutral side bars 75 and 80 of electrical panel 32. In addition, in a manner similar to the stab 60 described above, the neutral bracket member 190 includes a leg 195 configured for electrical connection to both transfer switches 95 and 140. The neutral bracket member 190 functions to maintain the voltage potential at each of the neutral bars 75 and 80 and the neutral bracket member 190 at or close to zero volts. The neutral bracket member 190 also provides an electrical connection for the return of electrical current flow from the load 42 via the neutral transfer switches 95 and 140 to the neutral conductors 45 and 48 of the utility service 35 and generator 40, respectively (See FIG. 1A).

2. Interlock Assembly

Referring now to FIGS. 1 and 2, the first and second switch assemblies 25 and 30 are provided with the interlock assembly 20 of the present invention configured to prevent the first and second switch assemblies 25 and 30 from being simultaneously in the ON position. The interlock assembly 20 thus ensures that the first and second multiple switch assemblies 25 and 30 will be mutually constrained so that only one of the switch assemblies 25 and 30 can be in the ON position at any one time. While the interlock assembly 20 prohibits both switch assemblies 25 and 30 from being in the ON position at the same time, it does allow both switch assemblies 25 and 30 to be simultaneously in the OFF position (See FIG. 2), as will later be explained.

Referring specifically to FIG. 2, the interlock assembly 20 includes a pair of identical, elongated, planar guide members, in the form of base strips 200 and 205, interconnected with an inner or lower interlock member 210 and an outer or upper interlock member 215. Both the strips 200 and 205 and the inner and outer interlock members 210 and 215 are typically formed of a rigid, metallic material which resists deformation, although it is understood that other satisfactory materials may be employed. The lower and upper interlock members 210 and 215, respectively, are slidably mounted and retained to slide along a longitudinal path defined by base strips 200 and 205.

Each of the pair of base strips 200 and 205 may be in the form of elongated metallic plates of substantially rectangular configuration and include a pair of adjacently disposed inner apertures configured to receive fasteners 216 therethrough, and outer threaded apertures to receive fasteners 218 therethrough. The threaded shafts of the fasteners 216 and 218 project into grooves 220 formed in the face of each multiple switch assemblies 25 and 30 so as to define a structure for guiding the interlock assembly 20 along a path formed by the existing structure of the switch assemblies 25 and 30 that enables an even distribution of force when the handle ties 170 and 175 and operating handles 156 and 160 are moved from one position toward the other. The type (e.g., screws, rivets, pins, snap-fit mechanism, etc.) and number of fasteners 216 and 218 can vary. It should be understood that other arrangements providing the same results are contemplated as being within the scope of the invention.

Still referring to FIG. 2, the lower interlock member 210 is in the form of a generally rigid control member disposed across coplanar faces of the transfer switches 90A, 90B, 95, 125A, 125B and 140, and configured for applying a linear force between the handle ties 170 and 175 and switch handles 154 and 160. The lower interlock member 210 is configured to be mounted on the aligned base strips 200 and 205. The preferred lower interlock member 210 is a one-piece component that includes a planar bight portion 225 between a series of stops 230A, 230B, 230C, 230D, 230E and 230F. The stops 230A, 230B, 230C, 230D, 230E and 230F generally extend upwardly in a perpendicular orientation relative to the planar bight portion 225, and are located for respective engagement with the inward faces of the switch handle ties 170, 175 and switch handles 154 and 160. The bight portion 225 includes four openings (not shown) which are oriented so as to be aligned with the inner threaded apertures formed in the base strips 200 and 205 to receive the fasteners 216 coupling the lower interlock member 210 and the base strips 200 and 205. Referring specifically to FIG. 2, the lower interlock member 210 further includes opposed ends 240 and 242 that extend upwardly and in substantially perpendicular alignment to the bight portion 225 and the stops 230A, 230B, 230C, 230D, 230E and 230F. The opposed end 240 includes an elongated slot 250 and the opposed end 242 includes an elongated slot 255. Slots 250 and 255 are generally aligned with one another.

As illustrated in FIG. 2, the upper interlock member 215 is generally rectangular-shaped and disposed to enclose the handles 154, 160, 170 and 175. Similar to the lower interlock member 210 described above, the upper interlock member 215 includes a planar bight portion 260 disposed between a series of stops 275A, 275B, 275C, 275D, 275E and 275F. In contrast to the lower interlock member 210, the a series of stops 275A, 275B, 275C, 275D, 275E and 275F of the upper interlock member 215 extend downwardly in a generally perpendicular orientation relative to the bight portion 260. The series of stops 275A, 275B, 275C, 275D, 275E and 275F are positioned for engagement with the outward faces of the handles 154, 160, and handle ties 170, 175. The upper interlock member 215 further includes opposed ends 280 and 285 that extend downwardly in a generally perpendicular orientation relative to the stops 275A, 275B, 275C, 275D, 275E and 275F. The opposed end 280 includes an opening 290 and the opposed end 185 includes an opening 295. The opening 290 is generally configured to align with the slot 250 of the lower interlock member 210, and the opening 295 is generally configured to align with the slot 255 of the lower member 210 so as to receive fasteners 296 therethrough for slidably interconnecting the lower and upper interlock members 210 and 215, respectively. Although not shown, an alternative construction can utilize fasteners extending through an aperture at the bight portion of the upper interlock member to slidably interconnect the upper and lower interlock members in a similar manner.

Referring to FIGS. 2, 3, 4, 5, 6, 7 and 9, the stop 275F is aligned at a predetermined offset distance (shown at d) relative to the stops 275D and 275E (See FIG. 9). With this construction, the inward face of the stop 275F will engage and move the handle 160 of the neutral transfer switch 140 to the ON position before the stops 275D and 275E move the handle tie 175 of the two-pole transfer switch 125 to the ON position. The offset distance (d) causes movement of the interlock assembly 20 to make the electrical connection of the neutral conductor 48 of the generator 40 before movement of the interlock assembly 20 makes electrical connection of the "hot" conductors 46 of the generator 40 so as to supply electrical power to the service bus conductors 50 and 55. Referring to FIGS. 2, 3, 4, 5, 6, and 7, in a similar construction to the stop 275F described above, the stop 275C is offset by a distance (also shown at d) relative to the stops 275A and 275B such that the stop 275C moves the handle 154 of the neutral switch 95 to the ON position before the stops 275A and 275B move the handle tie 170 of the two-pole switch 90 to the ON position. Likewise, this relative offset of the stop 275C causes movement of the interlock assembly 20 to make the electrical connection of the neutral conductor 45 of the utility service 35 before movement of the interlock assembly 20 makes electrical connection of the "hot" conductors 44 of the utility service 35, so as to supply electrical power to the service bus conductors 50 and 55.

FIGS. 3-7 illustrate representations of a sequence of movement of the interlock assembly 20 of the invention in switching to a typical feed of electrical power from the utility service 35 to the electrical panel 32, and then switching to a feed of electrical power from the generator source 40 to the electrical panel 32.

In assembly, both switch assemblies 25 and 30 are in the OFF position such that there is no electrical feed to the electrical panel 32. To install the interlock assembly 20, the base strips 200 and 205 are attached to define the guide structure for sliding movement of the interlock assembly 20 in switching the ON-OFF operation of the multiple transfer switch assemblies 25 and 30. An underside of the lower interlock member 210 is then placed on top such that the apertures are aligned to receive the fasteners so as to rigidly attach the lower interlock member 210 at the base strips 200 and 205. The distance between the stop 230A and stop 230D is predetermined such that the operating handle tie 170 moves over-center to the OFF position before the stop 230D allows the handle tie 175 to be moved to the ON position, and vice versa (i.e., the operating handle tie 175 moves over-center to the OFF position before the stop 230A allows the handle tie 170 to be moved to the ON position). In addition, each base strip 200 and 205 preferably has a length that extends at least to, and preferably beyond, the outward faces of the handle ties 170 and 175 and the handles 154 and 160 when in the OFF position. The upper interlock member 215 is then slidably coupled via fasteners 300 inserted through opening 290 and slot 240 and through opening 295 and slot 255, such that the interlock assembly 20 is movably retained relative to the switch assemblies 25 and 30.

During normal operation, the first and second multiple switch assemblies 25 and 30 are each positioned as illustrated in FIG. 3 when electrical power is normally supplied by the utility service 35. When electrical power is supplied via the utility service 35 to the electrical panel 32, the neutral bracket member 190 (See FIG. 1) is operable to complete the electrical path so as to return the flow of electrical current via electrical connection of the single-pole transfer switch 95 to the neutral conductor 45 of the utility service 35 (See FIG. 1A).

Figure 4:
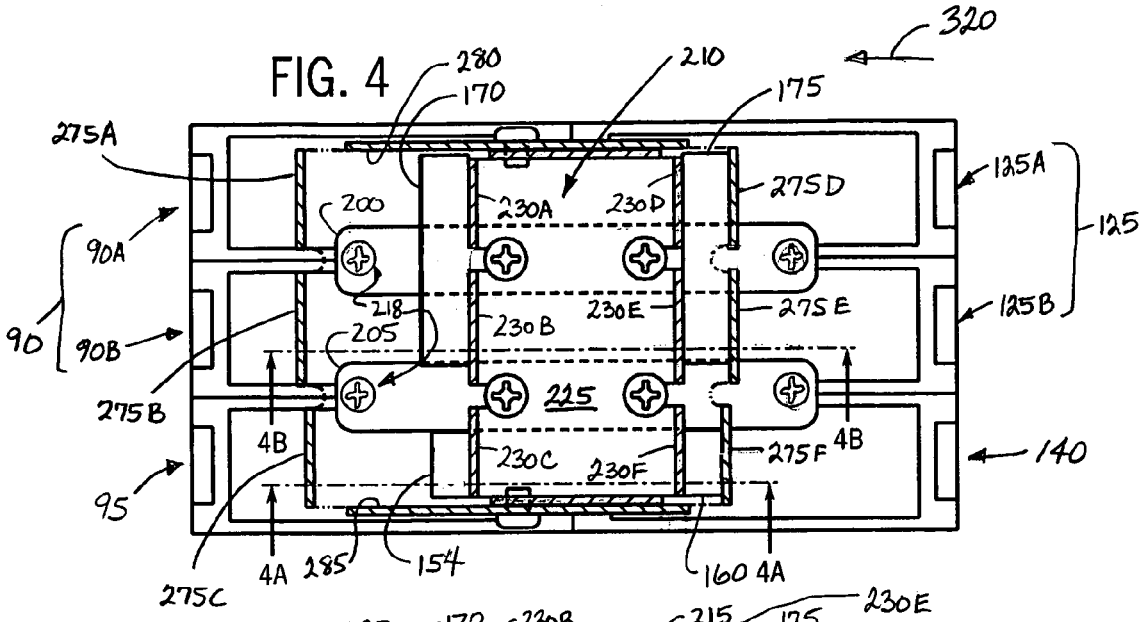
FIG. 4 is a top plan view, partially in cross-section, of the interlock assembly in combination with the transfer switch assemblies of the electrical panel of FIG. 1, showing the interlock assembly in a second operative position.
Figure 4B:
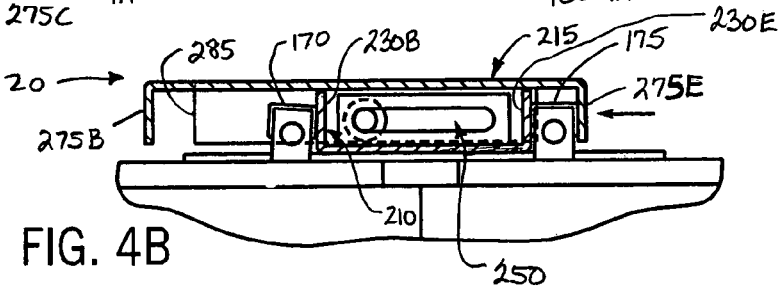
FIG. 4B is a section view along line 4B-4B of FIG. 4.
Figure 4A:
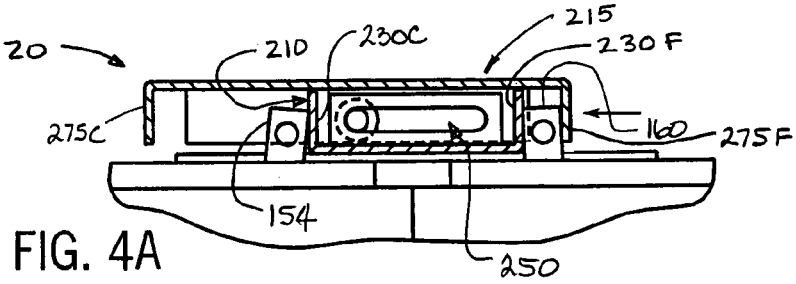
FIG. 4A is a section view along line 4A-4A of FIG. 4.

FIG. 4 illustrates movement of the interlock assembly 20 to interrupt the supply of power from the utility service 35 and making an electrical connection so that power is supplied from the generator 40. The operator applies a manual force from a right to left direction (illustrated by arrow and reference character 320) to move the lower and upper interlock members 210 and 215, respectively, so as to move the handle 160 and handle tie 175. In this position, the handles have not been moved in an amount sufficient to open or close either of the multiple switch assemblies 25 or 30.

FIG. 5 shows additional movement of the interlock assembly 20 from the right to the left direction. Both the first and second two-pole transfer switches 90 and 125 have handle ties 170 and 175, respectively, which adds a material thickness relative to the handles 154 and 160. Movement of the stops 230A and 230B causes the thicker handle tie 170 of the two-pole transfer switches 90 to move over-center to the OFF position before movement of stop 230C moves the neutral switch handle 154 of the neutral transfer switch 95 over-center to the OFF position.

Figure 6:
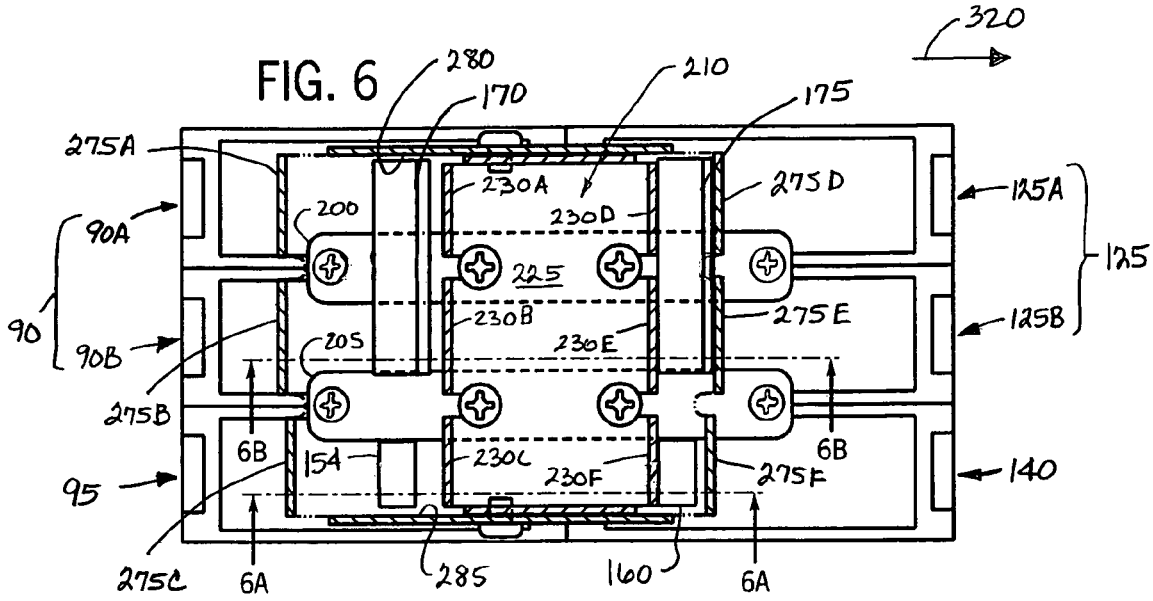
FIG. 6 is a top plan view, partially in cross-section, of the interlock assembly in combination with the transfer switch assemblies of the electrical panel of FIG. 1, showing the interlock assembly in a fourth operative position.
Figure 6B:
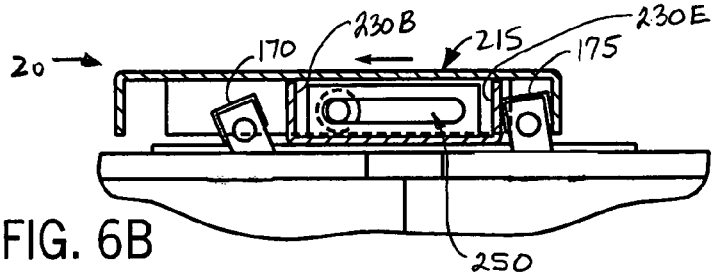
FIG. 6B is a section view along line 6B-6B of FIG. 6.
Figure 6A:
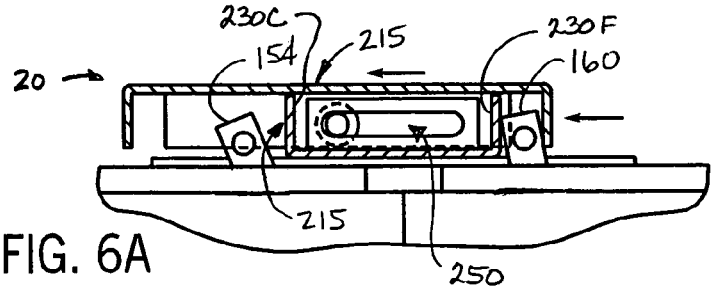
FIG. 6A is a section view along line 6A-6A of FIG. 6.

FIG. 6 shows additional switching actions taking place with continued movement of the interlock assembly 20 in the right to left direction. Specifically, the continued movement of the stop 275F causes movement of the lower interlock member 210 and attached stop 230C so as to cause the handle 154 of the neutral transfer switch assembly 95 to move over-center to the OFF position. After this takes place, the offset (d) of the stop 275F causes movement of the handle 160 of the neutral transfer switch 140 over-center to the ON position before movement of the handle tie 175 of the two-pole switch assembly 125 over-center to the ON position.

Figure 7:
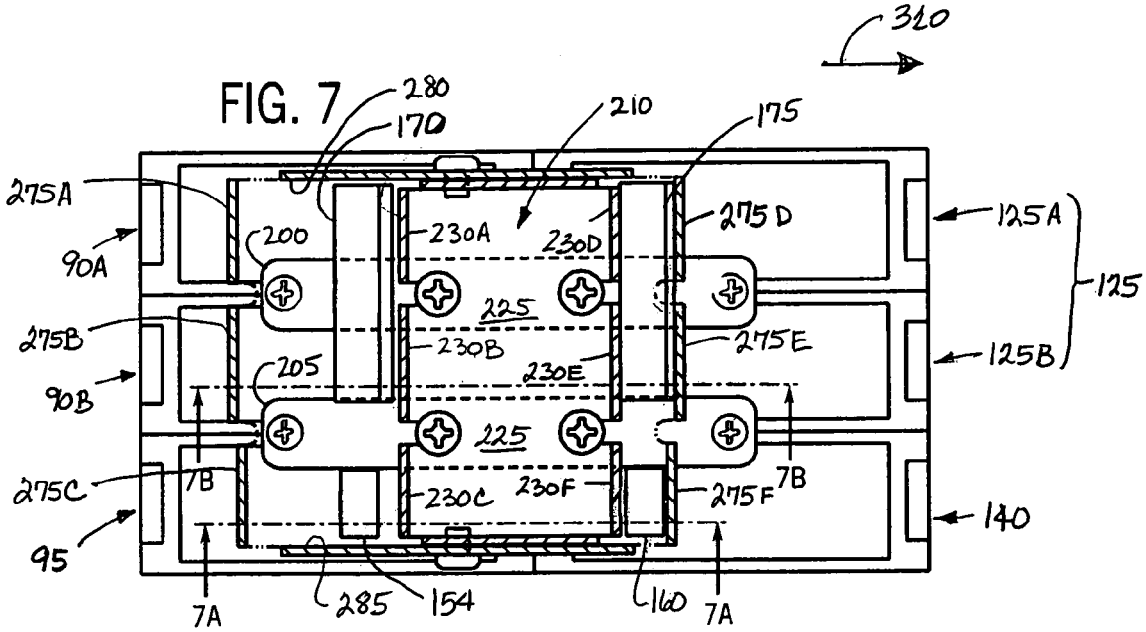
FIG. 7 is a top plan view, partially in cross-section, of the interlock assembly in combination with the transfer switch assemblies of the electrical panel of FIG. 1, showing the interlock assembly in a fifth operative position.
Figure 7B:
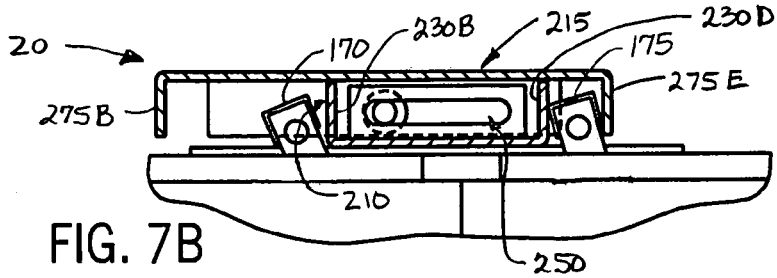
FIG. 7B is a section view along line 7B-7B of FIG. 7.
Figure 7A:
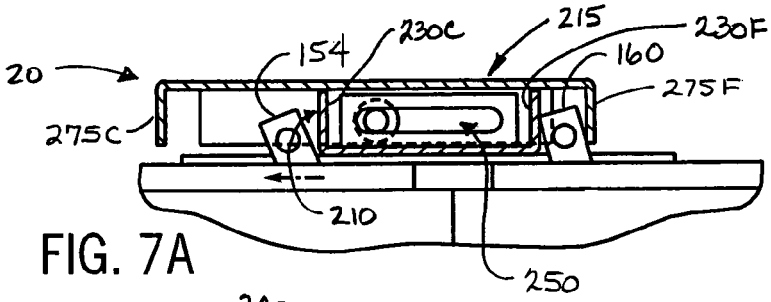
FIG. 7A is a section view along line 7A-7A of FIG. 7.

FIG. 7 shows the end of the right to left travel movement 320 of the interlock assembly 20 associated with switching the power supply from the utility service 35 to the generator 40 (See FIG. 1A). With the handle 160 of the neutral switch assembly 140 already in the ON position, the continued movement of the stop 275F causes the handle tie 175 of the two-pole transfer switch 125 to move over-center to the ON position such that the first and second service bus conductors 50 and 55 are now fed electrical power from the generator 40. When electrical power is supplied from the generator 40, the neutral bracket member 190 is electrically connected to complete the electrical path so as return the flow of electrical current via electrical connection of the single-pole transfer switch 140 to the neutral conductor 48 of the generator 40.

To switch back to the supply of power from the utility service 35, the above process is reversed so as to move the interlock assembly 20 in the left to right direction. Specifically, the sequence is as follows: the stops 230D and 230E move the handle tie 175 of the two-pole switch assembly 125 to the OFF position, then the stop 230F moves the handle 160 of the neutral switch assembly 140 to the OFF position, then the stop offset (d) of the stop 275C moves the handle 154 of the utility neutral transfer switch assembly 95 to the ON position before the stops 275A and 275B move handle tie 170 of the two-pole switch assembly 90 to the ON position.

Figure 8B:
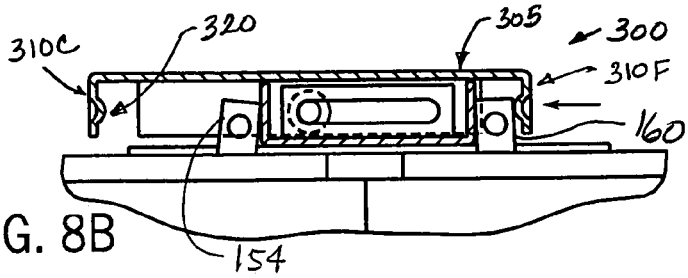
FIG. 8B is a section view similar to FIG. 8A, showing the interlock assembly in a second operative position similar to FIG. 4A.
Figure 8D:
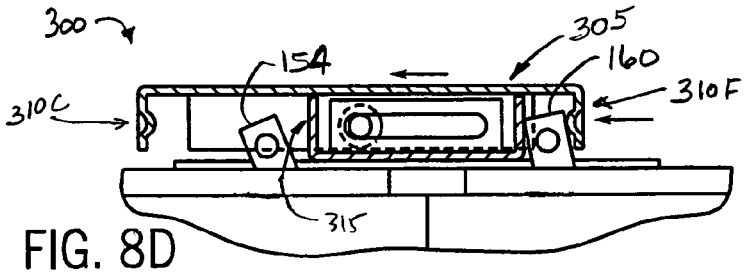
FIG. 8D is a section view similar to FIG. 8A, showing the interlock assembly in fourth operative position similar to FIG. 6A.
Figure 8E:
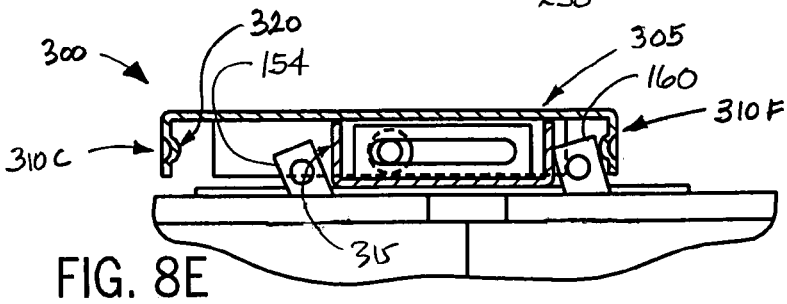
FIG. 8E is a section view similar to FIG. 8A, showing the interlock assembly in fourth operative position similar to FIG. 7A.
Figure 12:
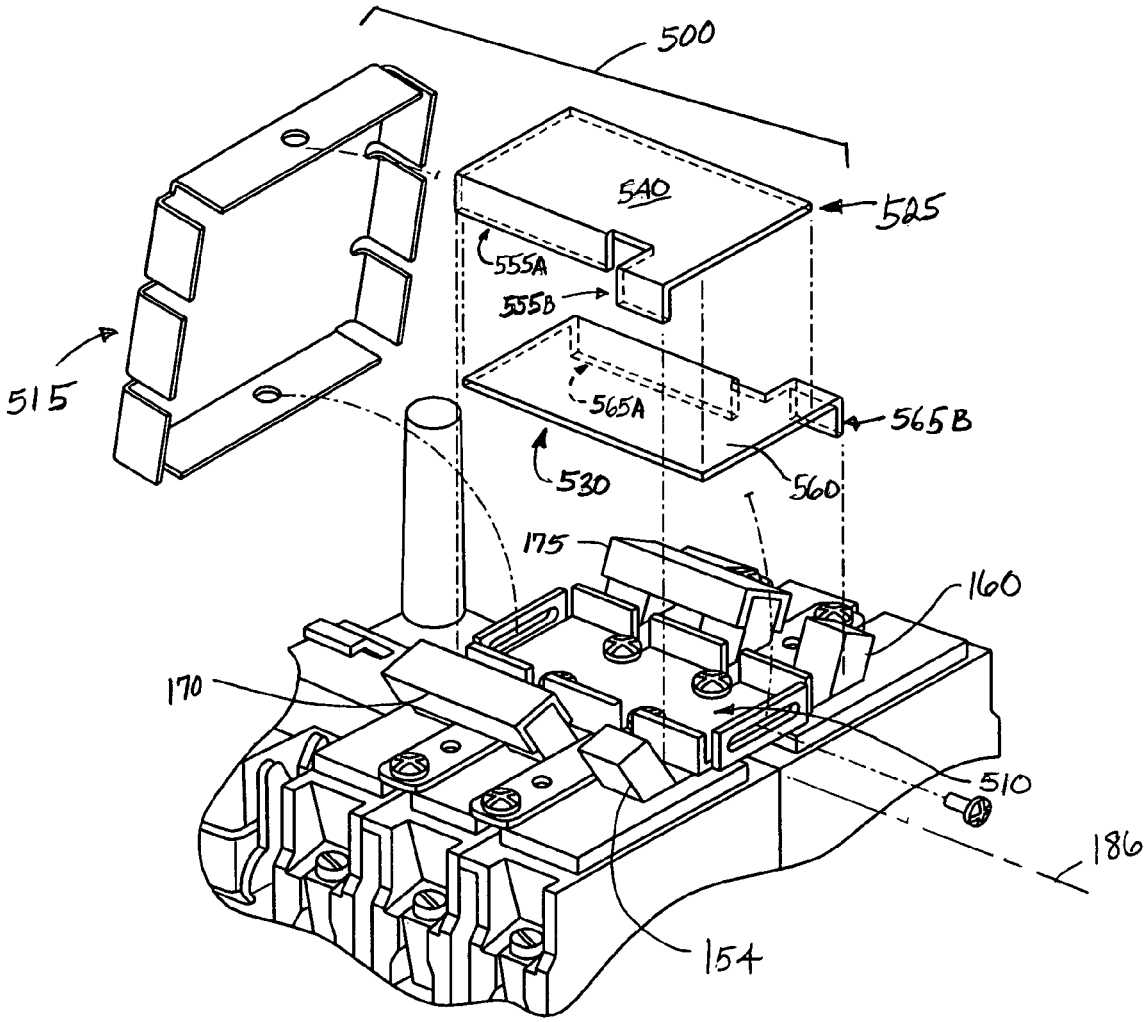
FIG. 12 is an exploded isometric view similar to FIG. 2, showing another embodiment of an interlock assembly in accordance with the present invention, for providing sequential actuation of switches including a neutral switch.
Figure 13:
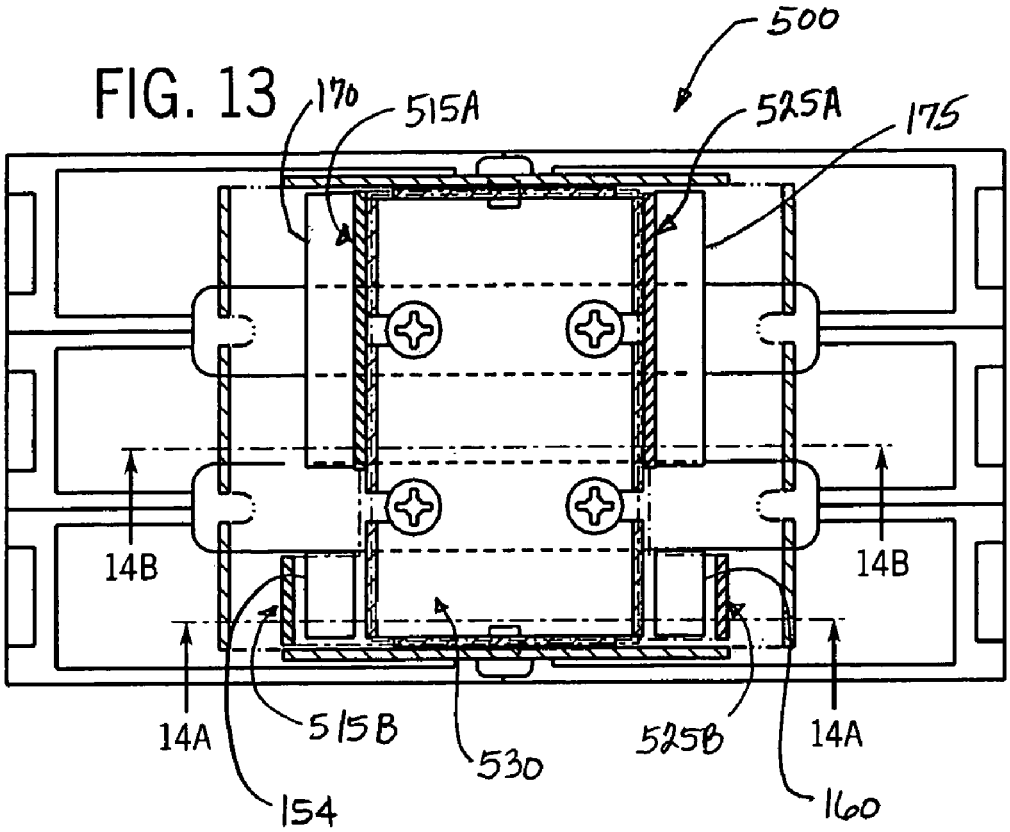
FIG. 13 is a top plan view, partially in cross-section, of the interlock assembly of FIG. 12 in combination with the transfer switch assemblies of the electrical panel of FIG. 1.
Figure 14B:
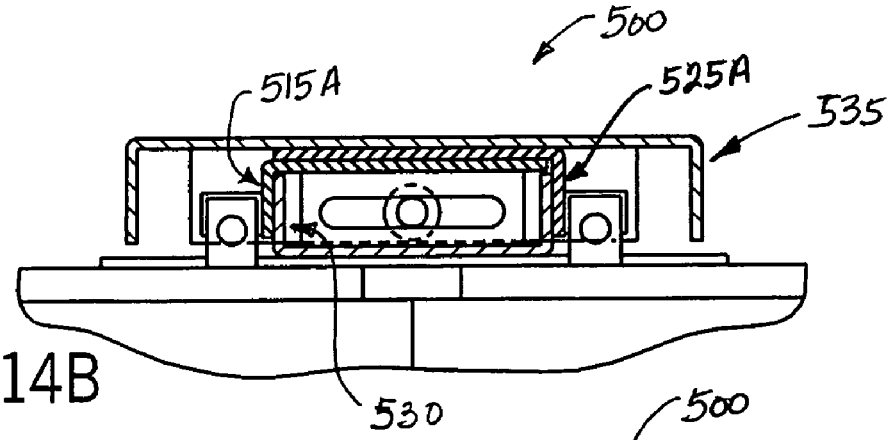
FIGS. 14A and 14B are partial section views taken along lines 14A-14A and 14B-14B, respectively, of FIG. 13.
Figure 14A:
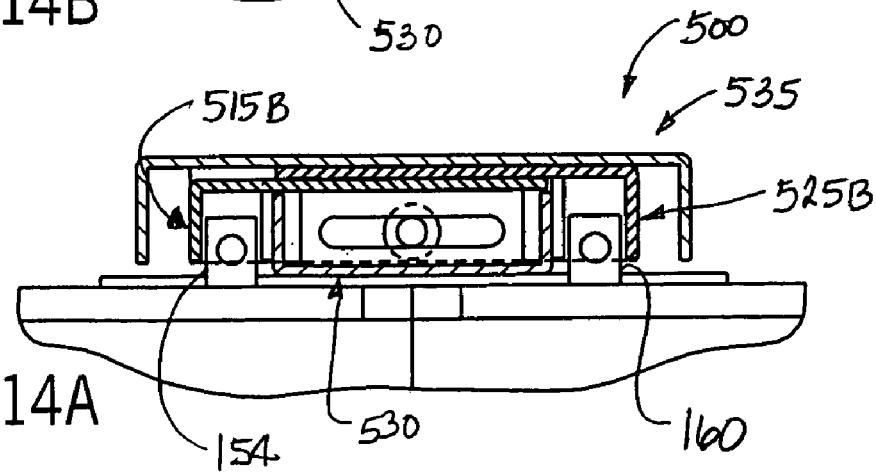

FIG. 8, along with FIGS. 8A-8E and FIG. 10, illustrate another embodiment of an interlock assembly 300 that includes an upper interlock member 305 with stops 310A, 310B, 310C, 310D, 310E and 310F, similar in construction to stops 275A, 275B, 275C, 275D, 275E, and 275F described above. However, in contrast to the offset (d) of stops 275C and 275F, the inner face of each stop 310C and 310F includes an extension or dimple 320 operable to engage the handles 154 and 160, respectively, in a sequenced manner before the inner face of the stops 310A, 310B, 310D and 310E engage handle ties 170 and 175. The depth of the dimple 320 from the inner face of each of stops 310C and 310F is similar in distance to the offset (d) of the stop 275F from the stop 275D and 275E as described above. Each dimple 320 is preferably machined-pressed into the stops 310C and 310F, although it is understood that the dimple 320 may assume any satisfactory configuration and may be formed in any satisfactory manner. Furthermore, the depth of the dimple can be variably adjusted for each type of multiple switch assembly 25 and 30. With this construction, in a manner similar to the interlock assembly 20, the interlock assembly 300 is operable to control the sequence at which the neutral switches 95 and 140, respectively, are moved to the ON position before the switches 90 and 125 are switched to the ON position. Specifically, FIG. 8A, 8B, 8C, 8D, and 8E illustrates sequential positions as an operator moves the interlock assembly 300 in switching the multiple transfer switches 25 and 30 from a normal mode of electrical power supply by the utility service 35 to a mode in which power is supplied by a generator 40, correlating to FIGS. 3, 4, 5, 6, and 7, respectively, as described above.

FIG. 11 illustrates yet another embodiment of an interlock assembly 400 in accordance with the present invention. Similar to the interlock assembly 20, the interlock assembly 400 includes an upper interlock member 405 with stop 410F to engage the handle 160 of switch 140. In contrast to the offset (d) of the stop 275F, the stop 410F is formed or aligned at an angle (β) with respect to vertical. With this construction, in a manner similar to the interlock assembly 20 described above, the interlock assembly 400 is operable to control the sequence at which the neutral switch 140, is moved to the ON position before the transfer switch 125 is switched to the ON position. Although not illustrated, it should be understood that the interlock assembly includes a stop similar in construction to the stop 410F to engage the handle 154 of the transfer switch 95.

These alternative embodiments can be used in lieu of, or in addition to taking advantage of the added material thickness of the two-pole switch handle ties 170 and 175.

FIGS. 12-14A show another embodiment of an interlock assembly 500 in accordance with the present invention. The interlock assembly 500 includes a lower interlock member 510 and an upper interlock member 515, similar to the lower and upper interlock members 210 and 215, respectively, of the interlock assembly 20 described above. The interlock assembly 500 further includes a first neutral linkage 525 and a second neutral linkage 530 that both are retained between the lower interlock member 510 and the upper interlock member 515. The first neutral linkage 525 includes a planar bight portion 540 and a stop 555A configured to interact with the switch handle tie 170, and a stop 555B configured to interact with the neutral switch handle 154. The stop 555A is located to engage the inward face of the handle tie 170, while the stop 555B is located to engage the outer face of the handle 154, relative to the central axis 186 of the panel 32. The second neutral linkage 530 has a symmetrical construction to the first neutral linkage 525, and includes a planar bight portion 560 and a series of stops 565A and 565B configured to interact with the handle tie 175 and the neutral switch handle 160, respectively, in a similar manner to the stops 555A and 555B described above. The stops 555A and 555B of the first neutral linkage 525 and the stops 565A and 565B of the second neutral linkage 530 are so formed to prevent inadvertent switching of the neutral switch handles 154 and 160 to the OFF position with switching the handle ties 170 and 175, respectively, to the OFF position. For example, as the operator moves the neutral switch handle 154 of the neutral transfer switch 95 from the ON to the OFF position, the neutral switch handle 154 engages the stop 555B so as to cause corresponding movement of the stop 555A and neutral linage 525. As neutral linkage 525 moves, the stop 555B moves the handle tie 170 of the transfer switch 90 to the "OFF" position. In this manner, neutral linkage 525 ensures that the transfer switch 90 is in the OFF position when the neutral transfer switch 95 is in the OFF position. It should be understood that the neutral linkage 530 operates in a similar manner to ensure that the handle tie 175 of the transfer switch 125 is in the OFF position when the handle 160 of the neutral transfer switch 140 is in the OFF position. The first and second neutral linkages 525 and 530 can be employed in combination with any of the embodiments of the interlock assemblies 20, 300, and 400 described above, thus illustrating yet another means of achieving the spacing necessary to provide the desired sequence of the switching operation between the first multiple transfer switch assembly 25 and the second multiple transfer switch assembly 30.

As a salient feature of the invention, the interlock assemblies 20, 300, 400, and 500 described above are quickly and easily installable for sliding engagement with the handle ties 170 and 175 as well as the switch handles 154 and 160, without disassembling the installed switch assemblies 25 and 30 and without deforming the interlock assemblies 20, 300, 400, and 500.

FIGS. 15-20 illustrate another embodiment of a sequential interlock assembly, shown at 600, in accordance with the present invention. Interlock assembly 600 includes a control member 602 that is movably mounted between switches 90*a*, 90*b* and 125*a*, 125*b*. The construction, installation and operation of control member 602 is as set forth in Flegel U.S. Pat. Nos. 6,031,193 issued Feb. 29, 2000 and 6,927,349 issued Aug. 9, 2005, the disclosures of which are hereby incorporated by reference. Control member 602 includes a slidable bar 604 and a U-shaped actuator 606 mounted to the upper surface of bar 604. Actuator 606 includes a mounting wall 608 that is secured to bar 604 via a pair of fasteners such as screws 610, in combination with a pair of upstanding actuator walls 612, 614.

In a manner as is known, switch handles 150, 152 are tied together for simultaneous movement by means of a handle tie member 616, which includes a top wall 618 and a pair of side walls 621. Each of switch handles 150, 152 includes a transverse passage P. Handle tie member 616 includes a pair of tabs 619, each of which is received within the passage P of one of switch handles 150, 152 to secure handle tie member 616 to switch handles 150, 152, as is known.

An actuator mounting member 623 is secured to switch handles 150, 152. Actuator mounting member 623 is a U-shaped member including a top wall 625 and a pair of end walls 620. Top wall 625 of actuator mounting member 623 overlies top wall 618 of handle tie member 616. End walls 620 are provided with threaded openings that are in alignment with transverse passages P, and a threaded connector in the form of a screw 622 is engaged within each threaded passage such that the screw shank extends into the switch handle passage P. With this construction, actuator mounting member 623 moves along with switch handles 150, 152 and handle tie member 616 between the ON and OFF positions relative to respective switches 90*a*, 90*b*. A similar handle tie member 616 is interconnected with switch handles 156, 158 of respective switches 125*a*, 125*b*, for moving switch handles 156, 158 simultaneously between the ON and OFF positions. Similarly, an actuator mounting member 623 is secured to switch handles 156, 158 for movement along with switch handles 156, 158, in the same manner as described above.

Interlock assembly 600 further includes a first neutral actuator 624 and a second neutral actuator 626. In a manner to be explained, neutral actuator 624 is secured to and movable with switch handles 150, 152 of switches 90*a*, 90*b*, respectively, and neutral actuator 626 is secured to and movable with switch handles 156, 158 of switches 125*a*, 125*b*, respectively, for providing movement of respective neutral switch handles 154, 160.

FIG. 16 illustrates the manner in which neutral actuator 624 is secured to switch handles 150, 152, and the following description with respect to neutral actuator 624 applies equally to connection of neutral actuator 626 to switch handles 156, 158.

As shown in FIGS. 15 and 16, neutral actuator 624 is generally in the form of a channel-shaped member having an upper wall 628, an outer side wall 630, and an inner side wall 632. Upper wall 628 and outer side wall 630 span the full distance between switch handle 150 and neutral switch handle 154. Inner side wall 632 spans between switch handle 152 and neutral switch handle 154, and terminates short of the area between switch handles 156, 158 that is in alignment with actuator wall 614 of actuator 606. With this construction, the area of neutral actuator 624 that spans between switch handle 152 and neutral switch handle 154 defines a channel or U-shaped configuration, and the area of neutral actuator 624 that spans between switch handles 150 and 152 defines an inverted L-shaped configuration. A portion of inner wall 632 overlies side wall 621 of handle tie member 616. The remainder of inner wall 621 is exposed, namely the portion of handle tie side wall 621 that is in alignment with actuator 606 and the portion of side wall 621 that overlies the inner surface of switch handle 150.

Upper wall 628 of neutral actuator 624 is connected to actuator mounting member 623, which is movable together with switch handles 150, 152, so that neutral actuator 624 is movable along with switch handles 150, 152 and handle tie member 616. In the illustrated embodiment, upper wall 628 of neutral actuator 624 overlies top wall 625 of actuator mounting member 623, and a pair of fasteners such as rivets 634 secure neutral actuator upper wall 628 and top wall 625 of actuator mounting member 623 together. Neutral switch handle 154 extends into the space defined between outer wall 630 and inner wall 632 of neutral actuator 624.

As shown in FIG. 17, outer side wall 630 of neutral actuator 624 includes an inwardly extending protrusion 636 that engages neutral switch handle 154. With this construction, neutral switch handle 154 is advanced slightly toward center relative to switch handles 150 and 152.

As shown in FIGS. 15 and 17, neutral actuator 626 includes an upper wall 638, an outer side wall 640 and an inner side wall 642 that are constructed similarly to upper wall 628, outer side wall 630 and inner side wall 632, respectively, of neutral actuator 624 as described previously. Similarly, outer side wall 640 of neutral actuator 626 includes an inwardly extending protrusion 644, which advances neutral switch handle 160 toward center relative to switch handles 156, 158. Neutral actuator 626 is mounted to actuator mounting member 623 for movement along with switch handles 156, 158, in the same manner as described above with respect to neutral actuator 624 and switch handles 150, 152.

FIGS. 17-20 illustrate the sequence of movement of interlock assembly 600 in switching to a typical feed of electrical power from utility service and then switching to a feed of electrical power from a generator source. During normal operation, the first and second multiple switch assemblies 25 and 30 are each positioned as shown in FIG. 17 when electrical power is normally supplied by the utility service 35. When electrical power is supplied via the utility service 35, the neutral bracket member 190 (FIG. 1) is operable to complete the electrical path so as to return the flow of electrical current via electrical connection of the single-pole transfer switch 95 to the neutral conductor 45 of the utility service 35.

FIG. 18 illustrates movement of the interlock assembly 600 to interrupt the supply of power from the utility service 35 and making an electrical connection so that power is supplied from the generator 40. The operator applies a manual force from a right-to-left direction on neutral actuator 626, which results in engagement of handle tie member 616 with actuator wall 614. This causes right-to-left movement of control member 602, as shown at arrow 648. During such movement of switch handles 156, 158, neutral actuator 626 advances neutral switch handle 160 ahead of switch handles 156, 158.

Switch handles 150, 152 and neutral switch handle 154 are biased in a rightward direction, which engages handle tie member 616 with actuator wall 612 between switch handles 150 and 152 when control member 602 is moved leftwardly. As shown in FIGS. 18A and 18B, the leftward movement of control member 602 functions to advance switch handles 150 and 152 ahead of neutral switch handle 154, due to the space between inner side wall 632 of neutral actuator 624 and the facing surface of neutral switch handle 154. In this manner, switch handles 150 and 152 are moved over-center to the off position before neutral actuator inner wall 632 moves neutral switch handle 154 of neutral transfer switch 95 over-center to the off position. Upon continued movement of control member 602, as shown in FIGS. 19A and 19B, switch handles 150 and 152 continue movement toward the off position ahead of neutral switch handle 154. At the same time, while neutral switch handle 154 is advanced behind switch handles 150 and 152, neutral switch handle 160 of neutral switch 140 is advanced ahead of switch handles 156, 158 due to engagement of protrusion 644 with neutral switch handle 160. Switch handles 150 and 152 are thus moved over-center to the OFF position before neutral switch handle 154 is moved over-center to the OFF position, while neutral switch handle 160 is moved over-center to the ON position before switch handles 156 and 158 are moved over-center to the ON position, as shown in FIGS. 19A, 19B and 20A, 20B.

To switch back to the supply of power from the utility service 35, the above process is reversed by manual left-to-right movement of neutral actuator 624, to move switch handles 150, 152 and neutral switch handle 154 to the ON position and to move switch handles 156, 158 and neutral switch handle 160 to the OFF position. In the same manner as described above, neutral actuators 624, 626 and control member 602 function to move switch handles 156, 158 to the OFF position before neutral switch handle 160 is moved to the OFF position, and to move neutral switch handle 154 to the ON position before switch handles 150 and 152 are moved to the ON position.

Figure 21:
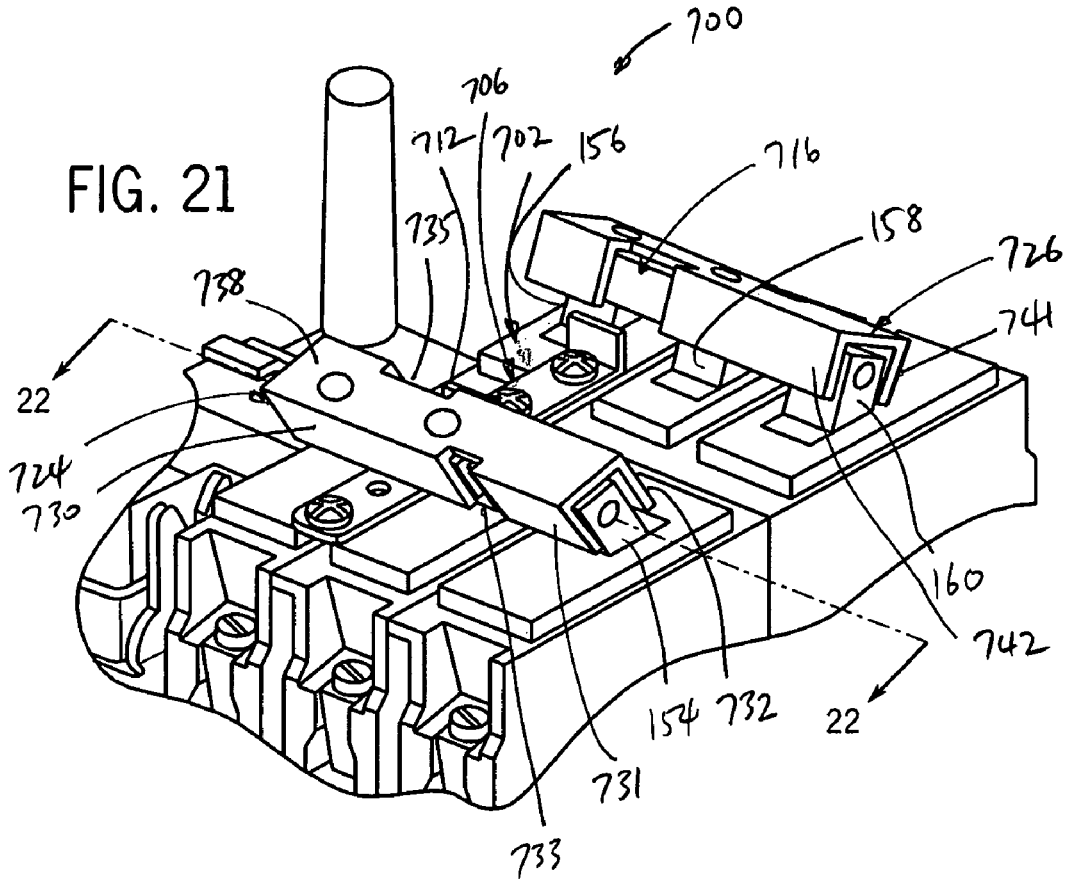
FIG. 21 is a partial isometric view showing another embodiment of an interlock assembly in accordance with the present invention, for providing sequential actuation of switches including a neutral switch.
Figure 22:
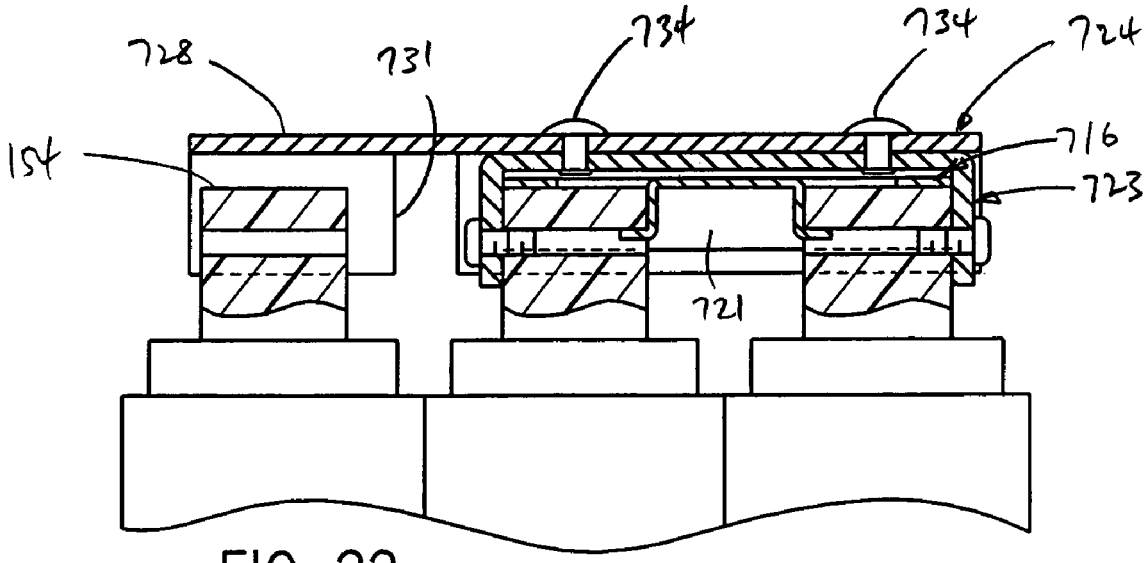
FIG. 22 is a partial section view taken along line 22-22 of FIG. 21.
Figure 23C:
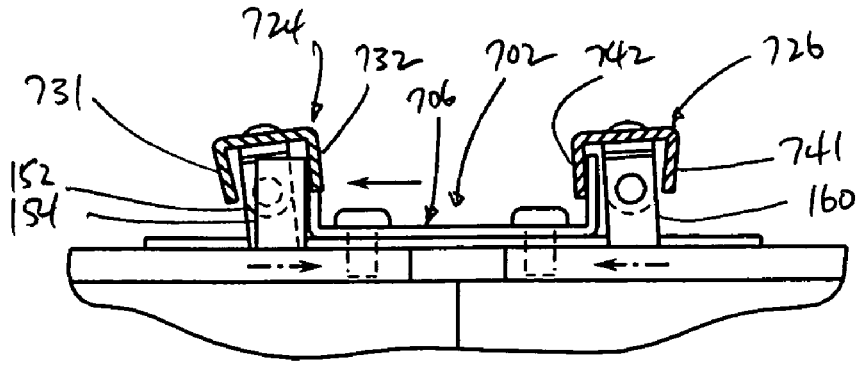
Figure 23D:
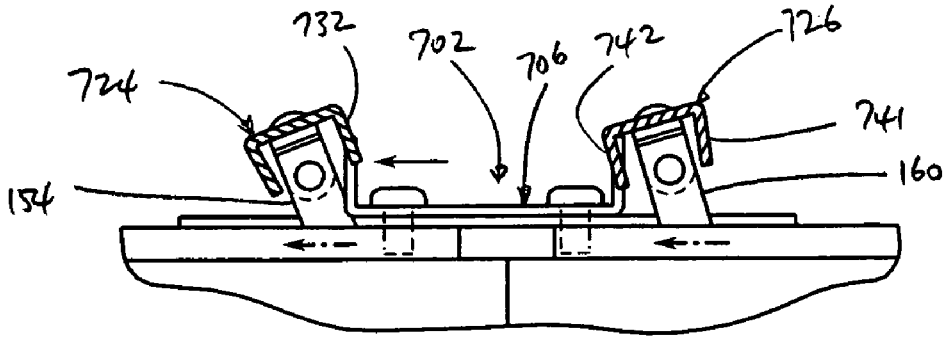

FIGS. 21-23 illustrate an interlock assembly 700 that functions along the same lines as interlock assembly 600 described above. Interlock assembly 700 includes a control member 702 having the same construction and operation as control member 602. In this version, a neutral actuator 724 is connected to an actuator mounting member 723 having the same construction and operation as actuator mounting member 623 described above, for securing neutral actuator 724 for movement with switch handles 150, 152. Similarly, a neutral actuator 726 is connected in the same manner to an actuator mounting member 723 that spans between and interconnects switches 156, 158.

Neutral actuator 724 has an upper wall 728 secured by rivets 734 to actuator mounting member 723. Neutral actuator 724 further includes an outer side wall 730 that spans between switch handles 150 and 152, and an angled outer neutral actuator wall 731 in alignment with neutral switch handle 154. A gap or space 733 separates outer side wall 730 and neutral actuator wall 731. Neutral actuator 724 further includes an inner side wall 732 that is in alignment with switch handles 150, 152 and with neutral switch handle 154. Inner side wall 732 includes a gap or space 735 that is in alignment with an actuator wall 712 of an actuator 706, which has the same construction and operation as described above with respect to actuator 606 in interlock assembly 600.

Neutral actuator wall 731 defines an acute angle with respect to upper wall 738 of neutral actuator 724, whereas outer side wall 730 of neutral actuator 724 is oriented generally perpendicular to upper wall 738. With this construction, the inner surface of neutral actuator wall 731 engages the facing surface of neutral switch handle 154 in a manner that advances neutral switch handle 154 ahead of switch handles 150, 152. The angled neutral actuator wall 731 provides the same function as protrusion 636 of neutral actuator 624 in interlock assembly 600. Neutral actuator 726 has the same construction as neutral actuator 724, including a neutral actuator wall 741 that acts on neutral switch handle 160 so as to advance neutral switch handle 160 relative to switch handles 156 and 158. The operation of interlock assembly 700 is the same as described above with respect to interlock assembly 600, with the difference being that the neutral switch handles are advanced by the angled neutral actuator walls as opposed to the protrusions in interlock assembly 600. The sequence of operation of interlock assembly 700 is illustrated in FIGS. 23A-D, and is the same as described previously with respect to FIGS. 17A, 17B, 18A, 18B, 19A, 19B and 20A, 20B.

Figure 24:
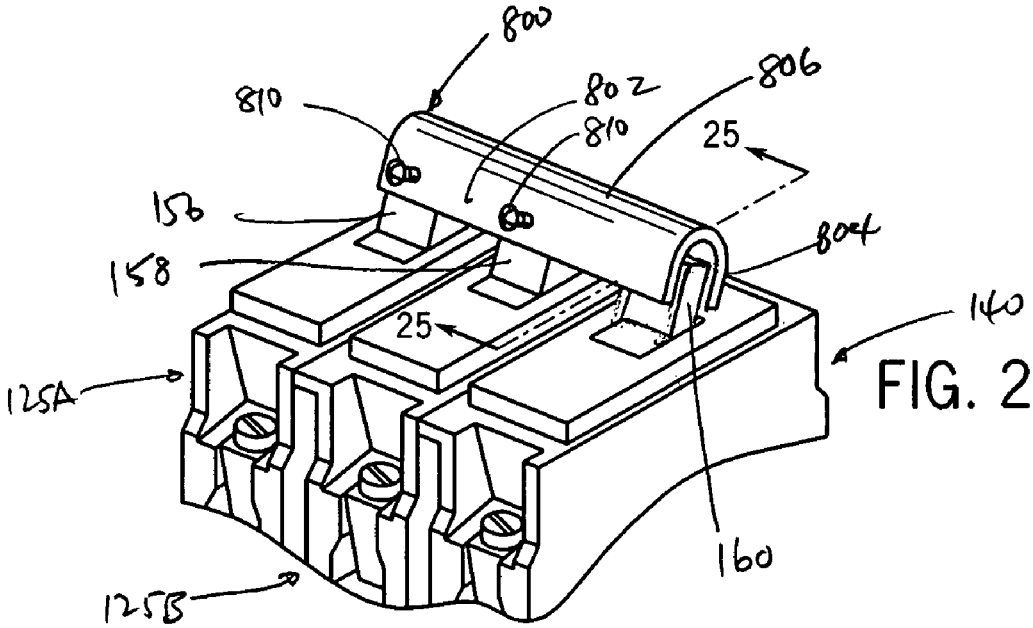
FIG. 24 is a partial isometric view of one embodiment of a switch handle tie or link system in accordance with the present invention, for use in connecting a number of switch handles for movement together.
Figure 25:
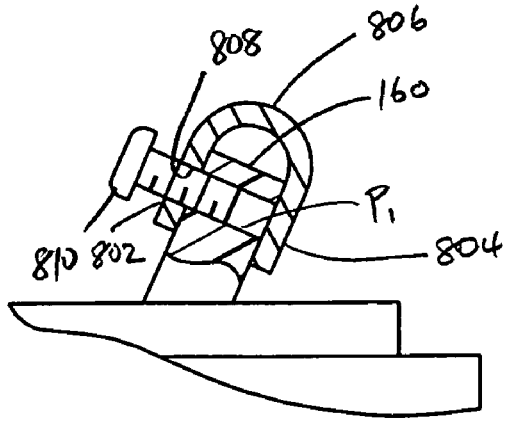
FIG. 25 is a partial section view taken along line 25-25 of FIG. 24.

It can be appreciated that the various embodiments of the interlock assemblies of the present invention as shown and described involve actuating a switch handle of a switch assembly that is located adjacent to a pair of switch assemblies that have tied-together switch handles. FIGS. 24-27 illustrate additional ways to actuate a switch handle that is located adjacent to switch handles that are tied together for movement. In the embodiment of FIG. 24, a tie member 800, which may be a neutral switch actuator as in the prior embodiments, has a generally U-shaped cross-section, defining a pair of spaced apart walls 802, 804 and a curved wall 806 extending therebetween. Walls 802 and 804 are spaced apart a distance only slightly greater than the thickness of the switch handles 156, 158. In this manner, the upper ends of switch handles 156, 158 are received within an axial recess or channel defined by tie member 800. Wall 802 includes a pair of threaded openings 808, each of which is adapted to be placed into alignment with a passage $P_1$ formed in the switch handles 156, 158. A fastener, such as a threaded screw 810, is engaged with each threaded opening 808, and the screw shank extends into the passage $P_1$. In this manner, tie member 800 is securely mounted to switch handles 156, 158 which thus move together between the ON and OFF positions. The end of the shank of screw 810 may engage the inner surface of wall 804 if desired. Alternatively, the switch handles 156, 158 may not include passages such as $P_1$. In an embodiment such as this, the end of the shank of screw 810 bears directly on the surface of the switch handle in order to connect the tie member 800 and switch handles 156, 158 together.

In this embodiment, tie member 800 is constructed such that the space between the facing inner surfaces of walls 802, 804 is greater than the thickness of the switch handle 160, and is similar to the space defined between the inner surfaces of walls 730, 732 of neutral actuator 724 and walls 740, 742 of neutral actuator 726. In this manner, tie member 800 provides sequenced switching of neutral switch 140 by delayed actuation of switch handle 160 when switch handles 156, 158 are moved together by operation of tie member 800. Alternatively, tie member 800 may be constructed such that the space between the facing inner surfaces of walls 802, 804 is the same with respect to neutral switch handle 160 as with respect to switch handles 156, 158, to provide simultaneous switching of neutral switch handle 160 upon movement of switch handles 156, 158.

Figure 26:
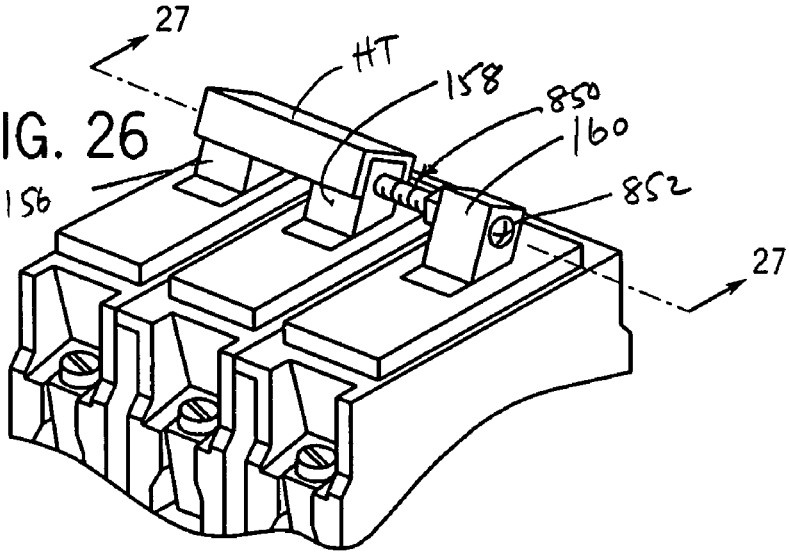
FIG. 26 is a partial isometric view similar to FIG. 24, showing another embodiment of a switch handle tie or link system in accordance with the present invention, for use in connecting a number of switch handles for movement together.
Figure 27:
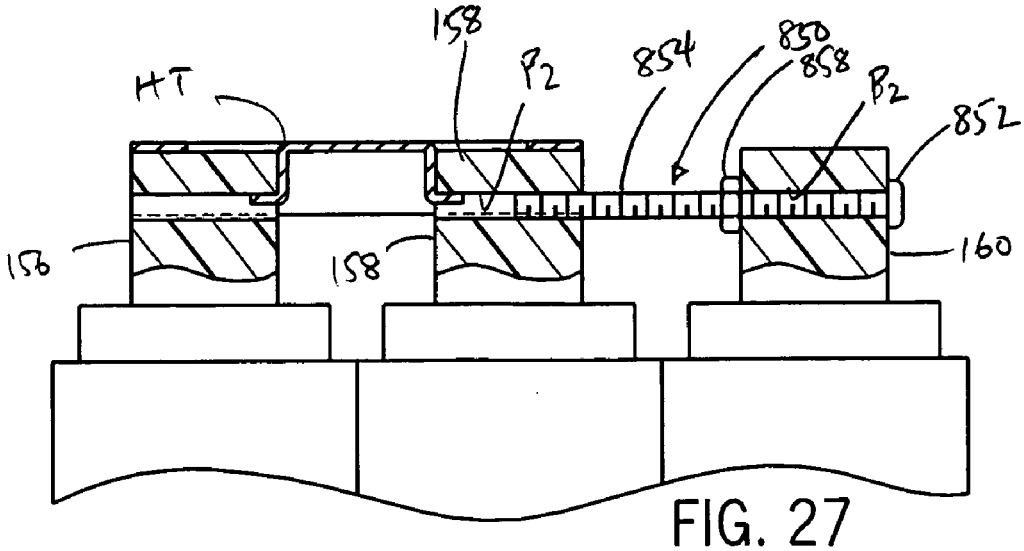
FIG. 27 is a partial section view taken along line 27-27 of FIG. 26.

Referring to FIGS. 26 and 27, switch handles 156 and 158 may be connected together by a conventional handle tie HT. In order to actuate switch handle 160 along with switch handles 156 and 158, a transverse connector 850 is engaged between switch handle 158 and switch handle 160. In the illustrated embodiment, connector 850 is in the form of a threaded screw that includes a head 852 and a shank 854. Screw shank 854 extends through a transverse passage $P_2$ formed in switch handle 160, and has a length sufficient to position an end portion of the screw shank 854 into the transverse passage $P_2$ of switch handle 158. A threaded retainer, such as a nut 858, is engaged with the screw shank 854 on the side of switch handle 160 opposite head 852, to maintain connector 850 in engagement with switch handle 160. With this construction, movement of switch handles 156, 158 is transferred through connector 850 to impart movement to switch handle 160.

While the invention has been shown and described with respect to particular embodiments, it is understood that alternatives and modifications are possible and are contemplated as being within the scope of the present invention. For example, and without limitation, while the above-described embodiments of the interlock assemblies 20 and 300, 400, 500 and 600 are shown as separate assemblies that are mounted to the electrical panel 32, the interlock assemblies 20, 300, 400, 500 and 600 may also be incorporated into the housing of the switches. In addition, the particular size, shape and configuration of the components of the interlock assemblies may vary from that shown, while performing the same function. In addition, while the interlock assembly is shown in connection with a dual switch arrangement, it is understood that the interlock assembly is equally adaptable to any number of aligned transfer switches. In addition, the drawings illustrate certain structure that is used to provide sequenced switch actuation, such as dimples or protrusions (e.g. 636, 644), or angled walls (e.g. 731, 741). It should be understood that any other satisfactory structure may be employed including, but not limited to, rivet heads, screw heads, screw shank ends, or any other primary or secondary attachments to the neutral actuator inner wall. Accordingly, the foregoing description is meant to be exemplary only, and is not limiting on the scope of the invention set forth in the following claims.

Various alternatives and embodiments are contemplated as being within the scope of the following claims particularly pointing out and distinctly claiming the subject matter regarded as the invention.

I claim:

1. A switching arrangement, comprising:

a first pair of switches, each of which includes a switch member movable between a connected position and a disconnected position, wherein a first switch member of the first pair of switches is movable between the connected position and the disconnected position to make or break a neutral connection;

a second pair of switches, each of which includes a switch member movable between a connected position and a disconnected position, wherein the switch members of the first pair of switches are spaced from the switch members of the second pair of switches and wherein a second switch member of the second pair of switches is movable between the connected position and the disconnected position to make or break a neutral connection; and an actuator arrangement interposed between the switch members of the first and second pairs of switches, wherein the actuator arrangement includes sequential actuating structure that is configured and arranged to act on the switch members to provide staggered movement of the switch members of one of the pair of switch members to and from the connected and disconnected positions when the switch members of the other of the pair of switch members are moved between the connected and disconnected positions, wherein the staggered movement includes movement of the first switch member to the connected position to make a first neutral connection before the switch member of the other of the first pair of switches is moved to the connected position, and movement of the second switch member to the connected position to make a second neutral connection before the switch member of the other of the second pair of switches is moved to the connected position.

2. A switching arrangement, comprising a first multiple switch assembly aligned with a second multiple switch assembly, the first multiple switch assembly having a first switch member adjacent to a second switch member, the second multiple switch assembly having a third switch member adjacent to a fourth switch member, the first and second switch members disposed away from the third and fourth switch members when all of the switch members are in an OFF position and towards each when all of the switch members are in an ON position, the second and fourth switch members each being movable between an ON and an OFF position to make or break a neutral connection, and an interlock assembly movably mounted relative to the switch assemblies, the interlock assembly being configured to control a sequence of switching the second switching member, and thereby interruption of the neutral connection, relative to switching the first switch member, as well as to control a sequence of switching the fourth switch member, and thereby interruption of the neutral connection, relative to switching the third switch member.

3. The switching arrangement as recited in claim 2, wherein the interlock assembly is configured to interrupt the first neutral connection after the first switch member is moved to the OFF position, and wherein the interlock assembly is configured to interrupt the second neutral connection after the third switch member is moved to the OFF position.

4. The switching arrangement as recited in claim 2, wherein the interlock assembly includes an actuator arrangement configured to move the second switch member to the OFF position and break the first neutral connection after the first switch member is moved to the OFF position.

5. The switching arrangement as recited in claim 2, wherein the interlock assembly includes an actuator arrangement configured to move the fourth switch member to the OFF position and break the second neutral connection after the third switch member is moved to the OFF position.

6. The switching arrangement as recited in claim 2, wherein the interlock assembly is configured to move the second switch member to the ON position and to make the first neutral connection before the interlock assembly moves the first switch member to the ON position, and wherein the interlock assembly is configured to move the fourth switch member to the ON position and to make the second neutral connection before the interlock assembly moves the third switch member to the ON position.

7. The switching arrangement as recited in claim 6, wherein the first and second switch members and the third and fourth switch members are each interconnected with a handle tie member configured to be engaged by the interlock assembly.

8. The switching arrangement as recited in claim 2, wherein the interlock assembly includes a series of actuation surfaces, wherein the series of actuation surfaces includes a first actuation surface configured to position the second switch member in the OFF position and a second actuation surface configured to position the fourth switch member in the OFF position, and wherein the first and second actuation surfaces are disposed at a first distance from the second and fourth switch members, respectively, that is less relative to a second distance of the remaining actuation surfaces from the first and third switch members from the remaining other actuation surfaces.

9. The switching arrangement as recited in claim 2, wherein the interlock assembly includes a series of actuation surfaces, wherein the series of actuation surfaces includes a first actuation surface configured to position the second switch member in the OFF position and a second actuation surface configured to position the fourth switch member in the OFF position, and wherein the first and second actuation surfaces are generally positioned at an angle inward toward the switch members relative to the other actuation surfaces.

10. The switching arrangement as recited in claim 2, wherein the interlock assembly includes a series of actuation surfaces, wherein the series of actuation surfaces includes a first actuation surface configured to position the second switch member in the OFF position, and a second actuation surface configured to position the fourth switch member in the OFF position, and wherein the first and second actuation surfaces each includes a dimple member configured to engage the second and fourth switch members, respectively.

11. A switch arrangement, comprising:

a first switch member adjacent to a second switch member;

a third switch member adjacent to a fourth switch member;

wherein the first and second switch members are positioned away from the third and fourth switch members when all of the switch members are in an OFF position and are positioned towards each other when all of the switch members are in an ON position;

wherein the second and fourth switch members are movable between an ON and an OFF position to make or break a neutral connection;

a control arrangement movably mounted relative to the switch members, wherein the control arrangement is configured and arranged to move the second switch member to the ON position to make a first neutral connection before the first switch member is moved to the ON position, and to move the fourth switch member to the ON position to make a second neutral connection before the third switch member is moved to the ON position.

12. The switch arrangement as recited in claim 11, wherein the control arrangement includes a first transmission member having a central portion between opposed outer ends that are configured to engage facing surfaces defined by the switch members.

13. The switch arrangement as recited in claim 12, further including:

at least one guide member movably mounted relative to the switch members, wherein the central portion of the first transmission member is carried by the guide member.

14. The switch arrangement as recited in claim 12, wherein the control arrangement includes a second transmission member having a central portion between opposed outer ends that are configured to engage oppositely facing surfaces defined by the switch members.

15. The switch arrangement as recited in claim 14, wherein the second transmission member is interconnected with the first transmission member.

16. The switch arrangement as recited in claim 15, wherein the first transmission member includes spaced upwardly extending edges, wherein each of the spaced upwardly extending edges includes an elongated slot opening configured to receive a fastener coupling the first transmission member to the second transmission member.

17. The switch arrangement as recited in claim 11, wherein the control arrangement includes a first actuator arrangement having a first interior actuator positioned to move the second switch member from the ON to the OFF position and break the first neutral connection after the first switch member is moved from the ON to the OFF position.

18. The switch arrangement as recited in claim 17, wherein the first actuator arrangement includes a second interior actuator positioned to move the fourth switch member from the ON to the OFF position and break the second neutral connection after the third switch member is moved from the ON to the OFF position.

19. The switch arrangement as recited in claim 11, wherein the control arrangement includes a first exterior actuator positioned to move the second switch member from the OFF to the ON position before the first switch member is moved from the OFF to the ON position.

20. The switch arrangement as recited in claim 19, wherein the second actuator arrangement includes a second exterior actuator positioned to move the fourth switch assembly from the OFF to the ON position before the third switch member is moved from the OFF to the ON position.

21. The switch arrangement as recited in claim 11, wherein the control arrangement includes a movable interlock member between the first and third switch members for preventing both the first and third switch members from being positioned in the ON position at the same time.

22. The switch arrangement as recited in claim 21, wherein the control arrangement further includes sequential actuating structure carried by the first and third switch members for moving the second and fourth switch members, respectively, to the ON position before the first and third switch members, respectively, are moved to the ON position from the OFF position.

23. The switch arrangement as recited in claim 22, wherein the sequential actuating structure comprises a first neutral actuator movable with the first switch member and configured to move the second switch member in response to movement of the first switch member, and a second neutral actuator movable with the third switch member and configured to move the fourth switch member in response to movement of the third switch member.

24. The switch arrangement as recited in claim 23, wherein each neutral actuator comprises a pair of spaced apart actuator surfaces, wherein the actuator surfaces of each neutral actuator are configured to engage the second and fourth switch members, respectively, in response to movement of the first and third switch members, respectively.

25. The switch arrangement as recited in claim 24, wherein each neutral actuator comprises an outer wall and a pair of depending walls, wherein the pair of depending walls define the pair of spaced apart actuator surfaces.

26. An electrical panel for switching between a first power source and a second power source different from the first power source, comprising:

a first switch assembly having a first switch member and a second switch member, the first switch member being movable in a first direction between an ON position and an OFF position for controlling the supply of electrical power to the electrical panel from the first power source, the second switch member being movable between an ON and an OFF position for controlling a first neutral connection to the first power source;

a second switch assembly having a third switch member and a fourth switch member, the third switch member being movable in the first direction between an ON and OFF position for controlling the supply of electrical power to the electrical panel from the second power source, the fourth switch member being movable between an ON and an OFF position for controlling a second neutral connection to the second power source; and an interlock assembly movably mounted relative to the first and second multiple switch assemblies, the interlock assembly configured to control a sequence of switching the second switch member and thereby the first neutral connection relative to switching the first switch member, and to control a sequence of switching the fourth switch member and thereby the neutral second neutral connection relative to switching the third switch member.

27. The electrical panel as recited in claim 26, wherein the interlock assembly is configured to move the second switch member so as to break the first neutral connection after the first switch member is moved from the ON to the OFF position.

* * * * *

UNITED STATES PATENT AND TRADEMARK OFFICE

CERTIFICATE OF CORRECTION

PATENT NO. : 7,462,791 B1
APPLICATION NO. : 11/370789
DATED : December 9, 2008
INVENTOR(S) : David D. Flegel It is certified that error appears in the above-identified patent and that said Letters Patent is hereby corrected as shown below:

IN THE CLAIMS

CLAIM 26, column 24, line 45, delete "neutral" 1st occurrence.

Signed and Sealed this

Fifth Day of May, 2009

JOHN DOLL
*Acting Director of the United States Patent and Trademark Office*